US007717218B2

(12) United States Patent
Matsumoto et al.

(10) Patent No.: US 7,717,218 B2
(45) Date of Patent: May 18, 2010

(54) SWIVELING WORK MACHINE

(75) Inventors: Takanori Matsumoto, Sakai (JP); Fumiki Sato, Sakai (JP); Shizuo Shimoie, Sakai (JP); Yoshihiro Kato, Wakayama (JP); Kenzo Koga, Izumi (JP)

(73) Assignee: Kubota Corporation, Osaka (JP)

( * ) Notice: Subject to any disclaimer, the term of this patent is extended or adjusted under 35 U.S.C. 154(b) by 954 days.

(21) Appl. No.: 11/371,341

(22) Filed: Mar. 8, 2006

(65) Prior Publication Data

US 2006/0226680 A1 Oct. 12, 2006

(30) Foreign Application Priority Data

Mar. 28, 2005 (JP) ..... 2005-092855

(51) Int. Cl.
*E02F 9/00* (2006.01)

(52) U.S. Cl. ..... 180/291; 180/69.24

(58) Field of Classification Search ..... 180/9.1, 180/9.23, 9.42, 291, 69.2, 69.24, 89.17, 312; 280/781

See application file for complete search history.

(56) References Cited

U.S. PATENT DOCUMENTS 1,883,464 A * 10/1932 Ball ..... 454/149
2,805,887 A * 9/1957 Selby ..... 296/102
4,397,481 A * 8/1983 Dion et al. ..... 280/781
5,715,615 A * 2/1998 Murakami et al. ..... 37/379
6,481,748 B1 * 11/2002 Okuda et al. ..... 280/755
6,499,556 B1 * 12/2002 Koyama ..... 180/311
6,732,825 B2 * 5/2004 Takeda ..... 180/68.5
7,188,865 B2 * 3/2007 Sugiyama et al. ..... 280/759
7,204,047 B2 * 4/2007 Murakami ..... 37/347
2005/0210717 A1 9/2005 Ueda et al.

FOREIGN PATENT DOCUMENTS

| | | |
|---|---|---|
| JP | 10-331195 | 12/1998 |
| JP | 2002061222 | 8/2000 |
| JP | 2003-064724 | 3/2003 |
| JP | 2003-074085 | 3/2003 |
| JP | 2005315051 | 12/2004 |

* cited by examiner

*Primary Examiner*—Frank B Vanaman
(74) *Attorney, Agent, or Firm*—The Webb Law Firm

(57) ABSTRACT

A swiveling work machine includes a traveling apparatus, a swivel base mounted on the traveling apparatus to be pivotable about a vertical axis, a hood disposed at a rear portion of the swivel base, the hood accommodating therein an engine, a support frame being disposed across over the engine, and a ROPS having a front end thereof fixed to the swivel base and a rear end thereof fixed to an upper portion of the support frame. The support frame includes a front leg member disposed on one lateral side of the ROPS, the front leg member extending to vicinity of a position forwardly of the swivel base.

6 Claims, 24 Drawing Sheets

SWIVELING WORK MACHINE

BACKGROUND OF THE INVENTION

1. Field of the Invention

The present invention relates to a swiveling work machine having a swivel base pivotally mounted on a traveling apparatus to be pivotable about a pivot axis.

2. Description of Related Art

There is known a swiveling work machine, such as a construction machine, having a swivel base pivotally mounted on a traveling apparatus to be pivotable about a vertical pivot axis, a hood accommodating an engine and disposed at a rear portion of the swivel base, a support frame disposed inside the hood so as to extend over across the engine, a ROPS (rollover protection structure) provided at a front side of the hood and exemplified by a cabin, a canopy, a safety frame, etc., the front side of the cabin being fixedly mounted on the swivel base and an upper portion of the rear end of the cabin being fixedly mounted on an upper portion of the support frame.

With this type of conventional swiveling work machine, the support frame includes a plurality of support legs and a support plate connected between upper ends of the support legs, the plurality of support legs including a front leg member which is inclined downward on its front side. However, this front leg member (support leg) does not project largely so as to be located laterally of the ROPS such as the cabin—it terminates at a position slightly forwardly of the engine. (see JP-A-10-331195, JP-A-2003-074085 and JP-A-2003-064724, for example).

Therefore, the above conventional construction has room for improvement in the respect of the load resistance of the front leg member (support leg) when the upper portion of the ROPS is subjected to a significant load from behind toward the front side.

SUMMARY OF THE INVENTION

In view of the above, an object of this invention is to provide a swiveling work machine with improvement in the above-described respect.

For accomplishing the above object, a swiveling work machine, according to the present invention, comprises:

a traveling apparatus;

a swivel base mounted on the traveling apparatus to be pivotable about a vertical axis;

a hood disposed at a rear portion of the swivel base, the hood accommodating therein an engine, a support frame being disposed across over the engine; and a rollover protection structure (ROPS) having a front end thereof fixed to the swivel base and a rear end thereof fixed to an upper portion of the support frame;

wherein said support frame includes a front leg member disposed on one lateral side of said ROPS, said front leg member extending to the vicinity of a front end of the swivel base.

With the above construction, as the front leg member projects more forwardly to be located on one lateral side of the ROPS, this front leg member extends by greater span in the fore and aft direction than the conventional construction. Therefore, even when the upper portion of the ROPS is subjected to a significant load from behind toward the front side, this front load can be sufficiently supported by the stiff projection of the front leg member, thus avoiding development of looseness of the support frame to the front side.

According to one preferred embodiment of the invention, said swivel base includes a vertical rib disposed erect thereon, a front end portion of said front leg member being fixed to a forward upper face of said vertical rib. To this end, for example, an upper plate can be fixed to the forward upper face of the vertical rib and the front end portion of the front leg member can be fixed to an upper face of said upper plate.

According to one preferred embodiment, a swing bracket for pivotally supporting an implement is connected to a front end of said vertical rib, a front end of said front leg member being fixed to the vicinity of an upper end of said swing bracket.

According to one preferred embodiment, said ROPS is provided at a front portion on one lateral side of the swivel base, and a side hood is provided at a front portion on the other lateral side of the swivel base, said front leg member extending between said side hood and said ROPS.

According to one preferred embodiment, a cover member is provided for covering, from an upper side of the front leg member, a region between said ROPS and said side hood, a first inspection window is provided in a rear end upper face of the cover member, a second inspection window corresponding to said first inspection window is provided in a front wall of said hood, and a lid member for closing said first inspection window and said second inspection window is detachably attached to said cover member. A first lid plate portion for covering said first inspection window from the upper side thereof and a second lid plate portion for covering said second inspection window from the front side thereof are provided, with the first lid plate portion and the second lid plate portion extending normal to each other.

According to one preferred embodiment of the invention, said engine includes an alternator, said second inspection window being disposed at a position corresponding to said alternator, said alternator being inspectable through said first inspection window and said second inspection window, when said lid member is detached from said cover member.

Further and other features and advantageous effects resulting therefrom will become apparent upon reading the following detailed disclosure with reference to the accompanying drawings.

Next, respective preferred embodiments of the present invention will be described, based on a backhoe as an example of a swiveling work machine. In the following discussion, unless indicated explicitly otherwise, a fore and aft direction, right/left direction and vertical direction will be used all relative to a forward traveling direction of the vehicle body as the fore and aft direction.

DESCRIPTION OF PREFERRED EMBODIMENTS

Next, preferred embodiments of a swiveling work machine relating to the present invention will be described respectively with reference to the accompanying drawings.

First Embodiment

Figure 1:
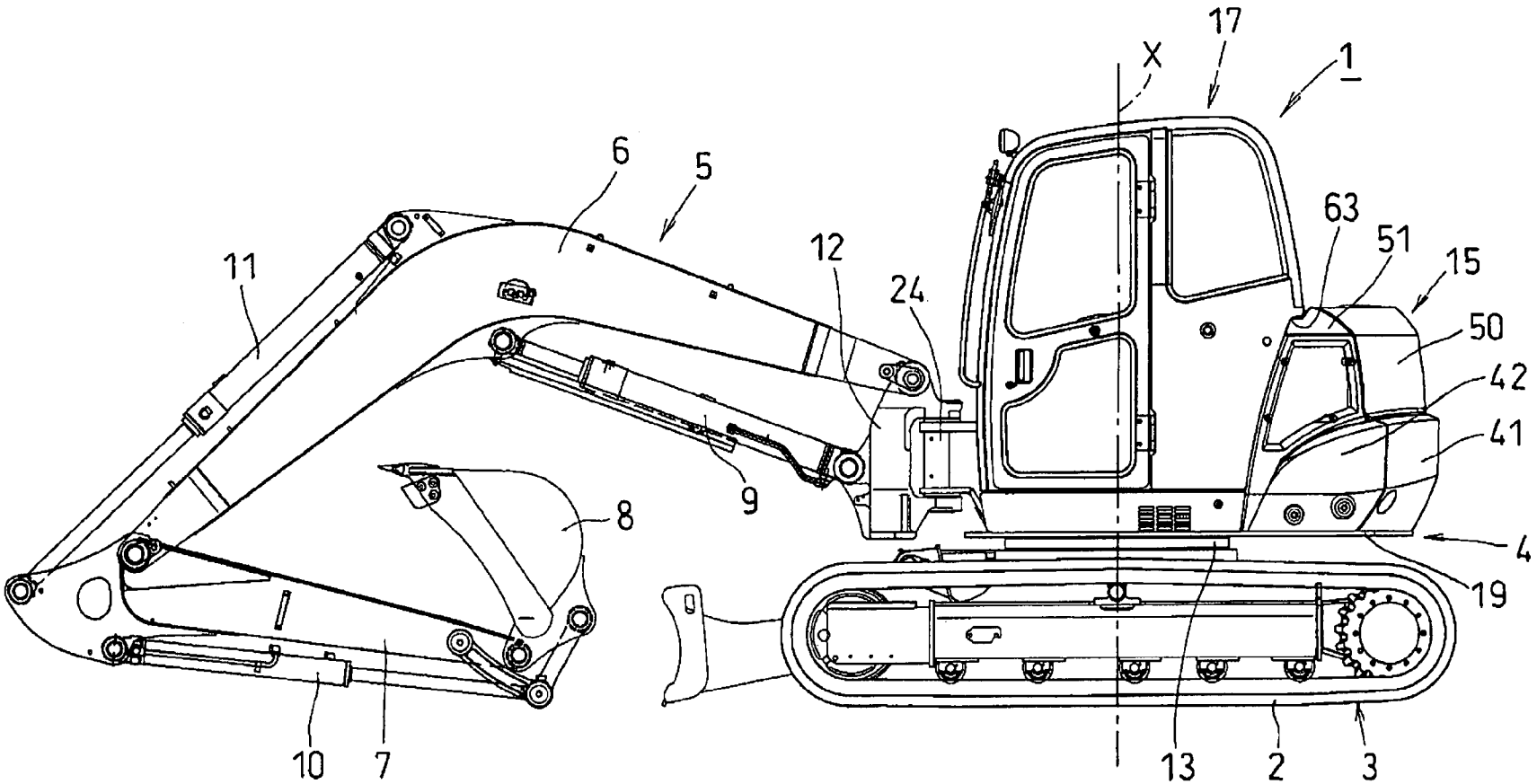
FIG. 1 is a view showing a swiveling work machine according to a first embodiment of the present invention, FIG. 1 being an overall side view of a backhoe as one specific example of the swiveling work machine.
Figure 2:
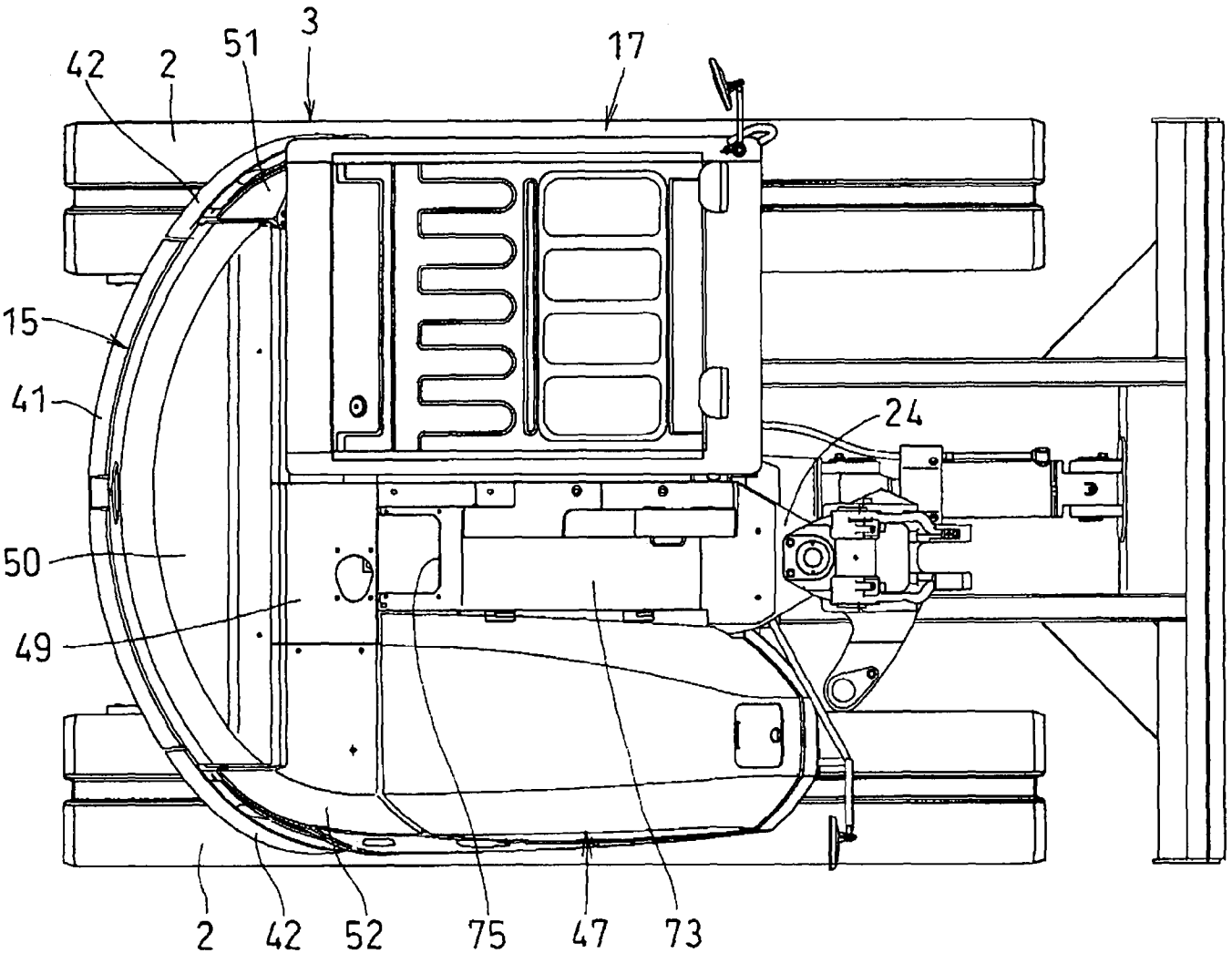
FIG. 2 is a plan view of the swiveling work machine (backhoe)
Figure 3:
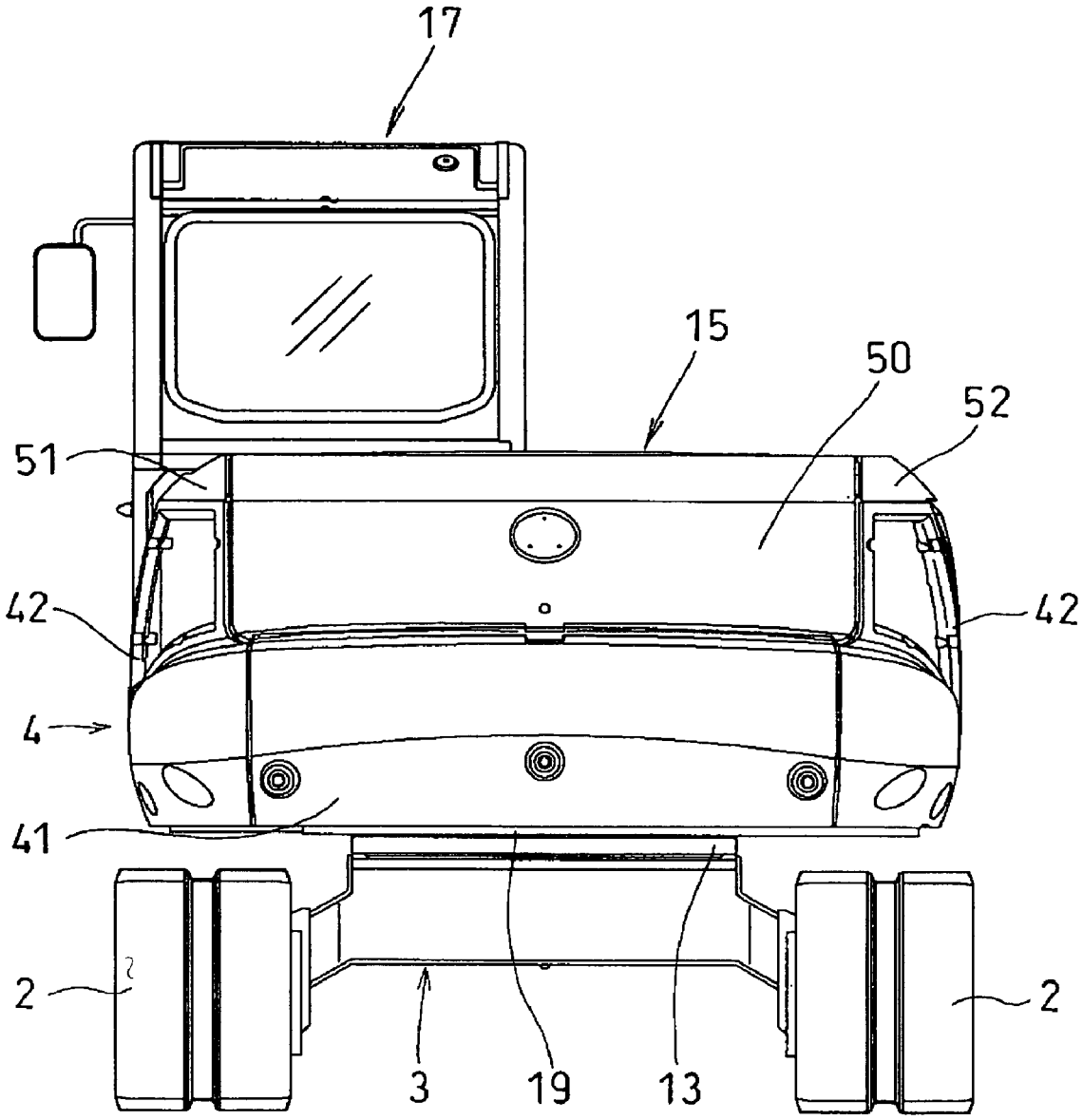
FIG. 3 is a rear view of the swiveling work machine.
Figure 4:
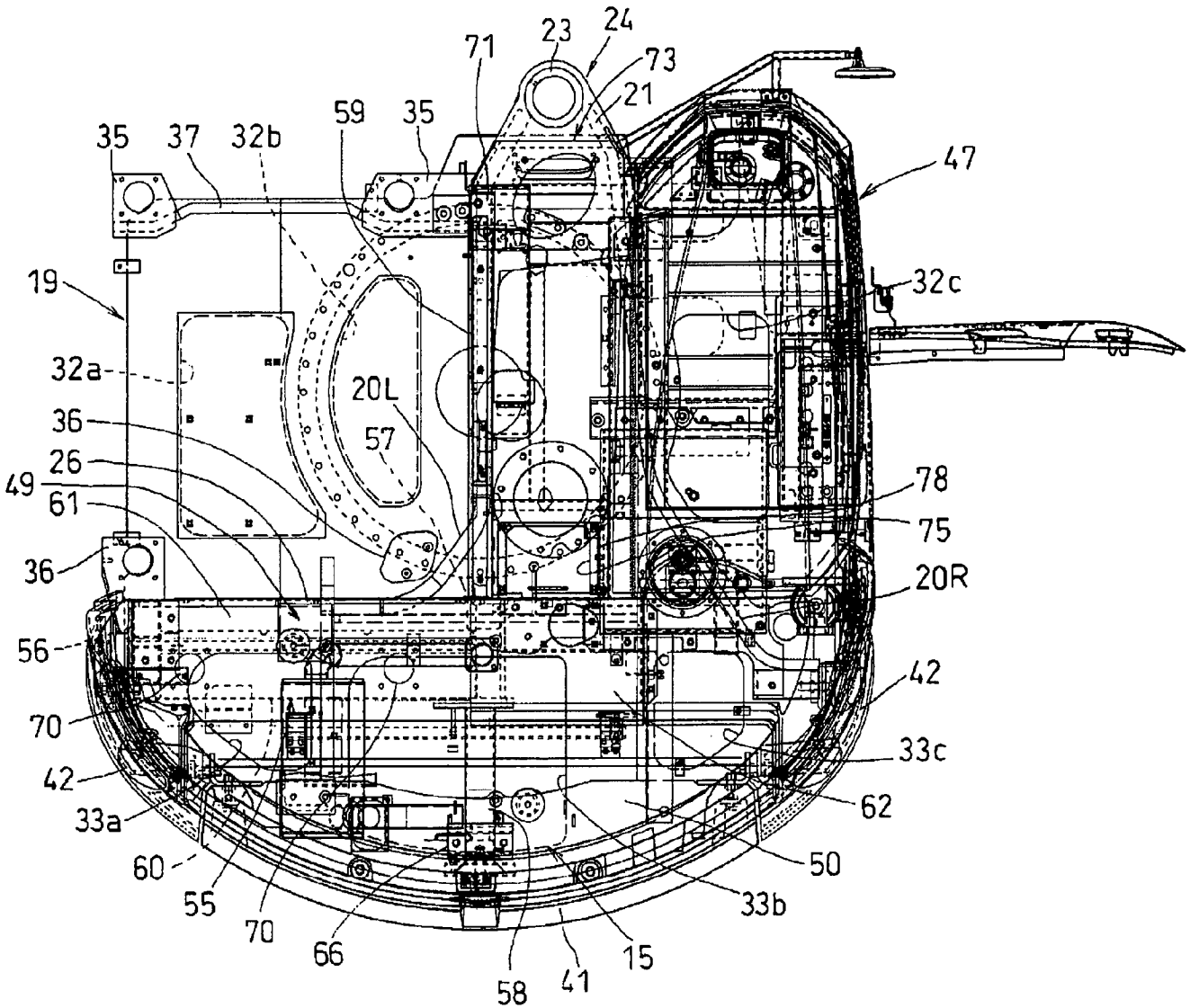
FIG. 4 is a plan view of a swivel deck with a cabin detached therefrom.

As shown in FIGS. 1-3, a backhoe (an example of "swiveling work machine") 1 includes a traveling apparatus 3 having a pair of right and left crawler traveling members 2 and a swivel deck 4 mounted atop the traveling apparatus 3, with the swivel deck 4 being pivotable about a vertical pivot axis X via a swivel bearing 13. To the front end of the swivel deck 4, there is attached an implement 5.

The implement 5 can be an excavator having a swing bracket 12 attached to the front end of the swivel deck 4 to be pivotable to the right/left, a boom 6 connected to the swing bracket 12 to be vertically pivotable, an arm 7 connected to the leading end of the boom 6 to be vertically pivotable, and a bucket 8 connected to the leading end of the boom 6 to be vertically pivotable. The swing bracket 12, the boom 6, the arm 7 and the bucket 8 are hydraulically operated by a boom cylinder 9, an arm cylinder 11 and a bucket cylinder 10, respectively. This implement 5 can include other work attachment than the bucket 8, such as a breaker.

At a rear portion of the swivel deck 4, there is mounted a rear hood (corresponding to "hood") 15, and forwardly of this rear hood 15, there is provided an operating section having a driver's seat, operational levers, operational pedals, etc. This operating section is surrounded by a cabin (an example of ROPS (rollover protection structure)) 17 provided at a front portion on the swivel deck 4.

As shown in FIGS. 4-11, at the bottom of the swivel deck 4, there is provided a swivel base 19 in the form of a plate. On this swivel base 19, there are disposed erect a pair of right and left vertical ribs 20R, 20L extending substantially along the fore and aft direction. More particularly, the two vertical ribs 20R, 20L are diverged or flared from the front side to the rear side of the swivel base 19. To the forward upper faces of the pair of right and left vertical ribs 20R, 20L, an upper plate 21 is fixed by e.g. welding. To the bottom faces of the front ends of the vertical ribs 20R, 20L, a lower plate 22 is fixed by e.g. welding. Between the front end of the upper plate 21 and the front end of the lower plate 22, a support cylinder 23 is fixed by e.g. welding. The front portions of the pair of vertical ribs 20R, 20L, the front portion of the upper plate 21, the lower plate 22 and the support cylinder 23 together constitute a mounting bracket 24 for mounting the implement 5. This mounting bracket 24 extends forwardly from the swivel base 19. To the front end of the mounting bracket 24, the swing bracket 12 (see FIG. 1) is connected via a vertical shaft (not shown), so that in association with extension/contraction of the swing cylinder (not shown), the swing bracket 12 and the implement 5 can be pivoted to the right/left about a vertical axis.

At a fore and aft intermediate portion of the swivel base 19, there is disposed erect a partitioning wall 26 extending in the right/left direction. As shown in FIGS. 12-15, on the rear side of the partitioning wall 26, there is formed an engine room 27 in which an engine 29, a radiator, etc. are disposed. At the rear end of the swivel base 19, an arcuate attaching wall 31 projects upwardly. At a front portion of the swivel base 19, there are formed a plurality of openings 32*a*, 32*b*, 32*c* and at a rear portion of the swivel base 19 too, a plurality of openings 33*a*, 33*b*, 33*c* are provided.

As shown in FIGS. 7-10, at the left front portion of the swivel base 19, there are provided a pair of right and left front cabin support members 35 for fixing thereto the front lower end of the cabin 17 and a pair of right and left rear cabin support members 36 for fixing thereto the rear lower end of the cabin 17. The right and left front cabin support members 35 are fixed respectively to the right and left sides of a support wall 37 disposed erect at the left front end portion of the swivel base 19 and the right and left rear cabin support members 36 are attached to the swivel base via stays (not shown).

As shown in FIGS. 1-8, at the rear end of the swivel base 19, there is provided a counter weight 41. On the right and left opposed sides of this counter weight 41, there are provided side protectors 42 for protecting right and left corners of the rear end of the swivel deck 4. The cabin 17 is disposed at a front portion of one lateral side (the left front side thereof in this embodiment) of the swivel base 19, and the rear hood 15 is disposed at the rear portion of the swivel base 19. Further, at the front portion of the other lateral side of the swivel base 19 (the right front side thereof in this embodiment), a side hood 47 is provided.

The rear hood 15 is disposed upwardly and forwardly of the counter weight 41 and on the right/left inner side of the pair of right and left side protectors 42. The counter weight 41, the pair of side protectors 42 and the rear hood 15 together constitute an engine room 27 surrounding the engine 29 over the rear end portion of the swivel base 19.

On the front side of the partitioning wall 36 and on the left side of the swivel base 19, there are disposed such components as a working oil tank a fuel tank, etc., with these components being covered by the side hood 47.

The rear hood 15 comprises a front cover 49, a rear cover 50, a left side cover 51 and a right side cover 52 and the front side and the front upper side of the engine room 27 are covered by the front cover 49.

As shown in FIG. 6, FIG. 10, FIG. 13 and FIG. 19, to a left cover member 61 and a right cover member 62 of a support frame 55 which will be described later, a front upper portion of the rear cover 50 is supported via a hinge member 53 to be pivotable about a right/left axis, so that the rear cover 50 can be flipped up about its front end upper portion (right/left axis).

As shown in FIGS. 4-19, within the rear hood 15, the support frame 55 is provided. This support frame 55 consists mainly of a left leg member 56, a right leg member 57, a rear leg member 58, a front leg member 59 and a support plate 60 connected to the respective upper ends of these leg members 56, 57, 58, 59 and the support frame 55 extends across and over the engine 44, i.e. striding over the engine 44. The support frame 55 includes, at upper portions thereof, the left cover member 61 and the right cover member 62 constituting the front cover 49 of the rear hood 15.

The left leg member 56 of the support frame 55 is formed of an angular pipe or the like. The right leg member 57 is formed of a metal rod having an L-shaped cross section. The lower ends of the left leg member 56 and the right leg member 57 are fixedly attached, by attaching plates 64, 65, via the partitioning wall 36, etc., to the swivel base 19. The lower end of the rear leg member 58 is fixedly attached to the swivel base 19 by an attaching plate 66 via the attaching wall 31.

The support plate 60 is a laterally elongate band plate-like member and the left end of this support plate 60 and the upper end of the left leg member 56 are fixedly connected to each other by e.g. welding. The right end of the support plate 60 and the upper end of the right leg member 57 are fixedly connected to each other by e.g. welding. The upper end of the rear leg member 58 is fixedly attached, via connecting plates 67, 68, to the rear end of the support plate 60 and the upper end of the right leg member 57. The upper end of the front leg member 59 is fixedly attached via the right cover member 62 to the upper end of the right leg member 57.

The front leg member 59 of the support frame 55 is disposed on one lateral side (the right side in this embodiment) of the cabin 17 and extends forwardly along this lateral side to the vicinity of the front end of the swivel deck 4 (swivel base 19). The front leg member 59 is formed of a metal rod having a C-shaped cross section and projects forwardly from the upper end of the right leg member 57 of the support frame 55. The front leg member 59 extending upwardly of the vertical rib 20L is bent in a forwardly downward direction and projects significantly forwardly, with its front end being bent downward. And, the lower end portion (front end portion) of the front leg member 59 is fixed, via an attaching plate 71 and a connecting plate 72, to the upper face of the upper plate 21 attached to the forward upper faces of the vertical ribs 20R, 20L. With this, the front portion of the front leg member 59 is disposed on the right outer side of the cabin 17 and the lower end portion (front end portion) of the front leg member 59 is fixed to the front end region of the swivel base 19 and the front leg member 59 is arranged between the cabin 17 and the side hood 47.

Figure 5:
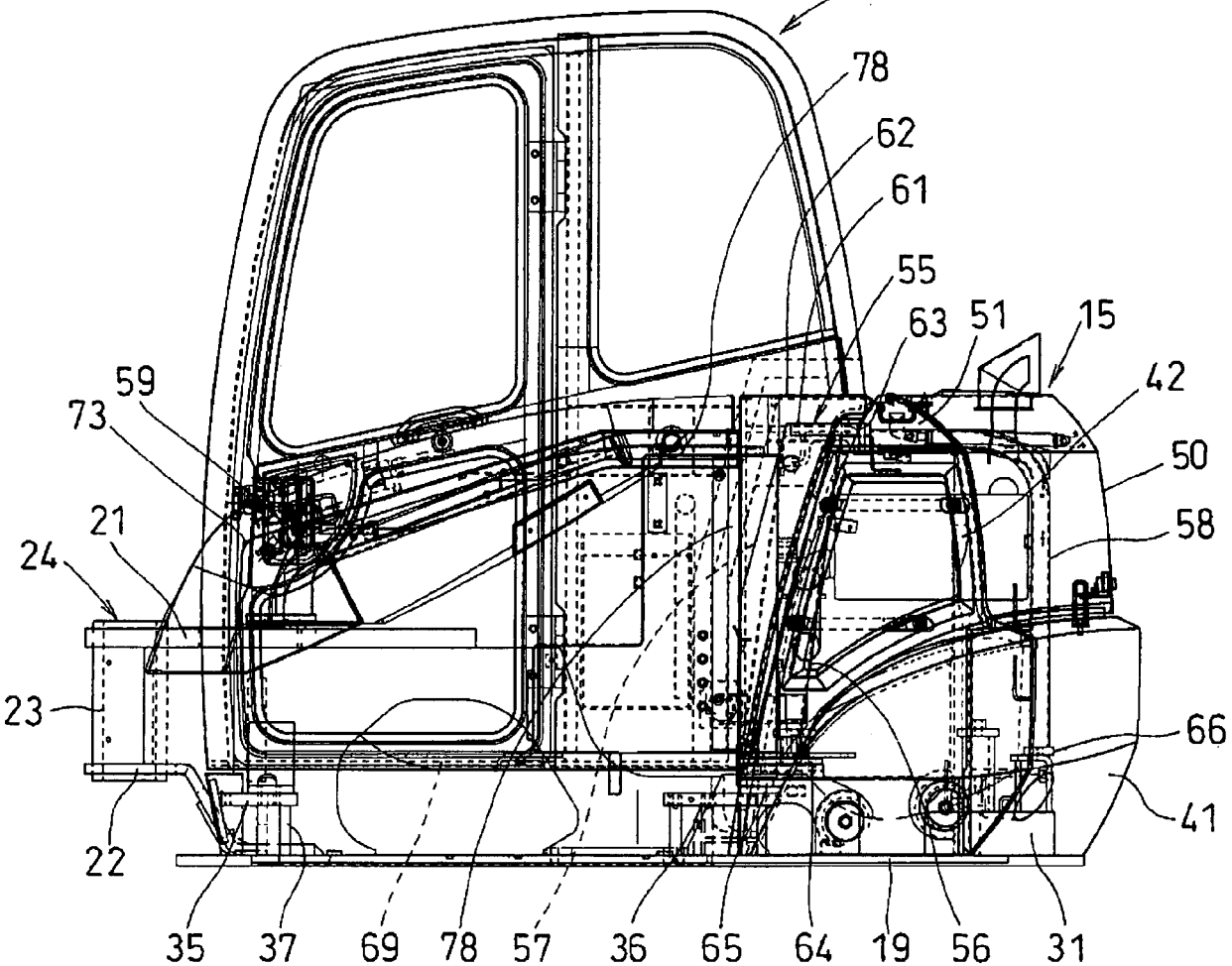
FIG. 5 is a left side view of the swivel deck with an implement detached therefrom.
Figure 6:
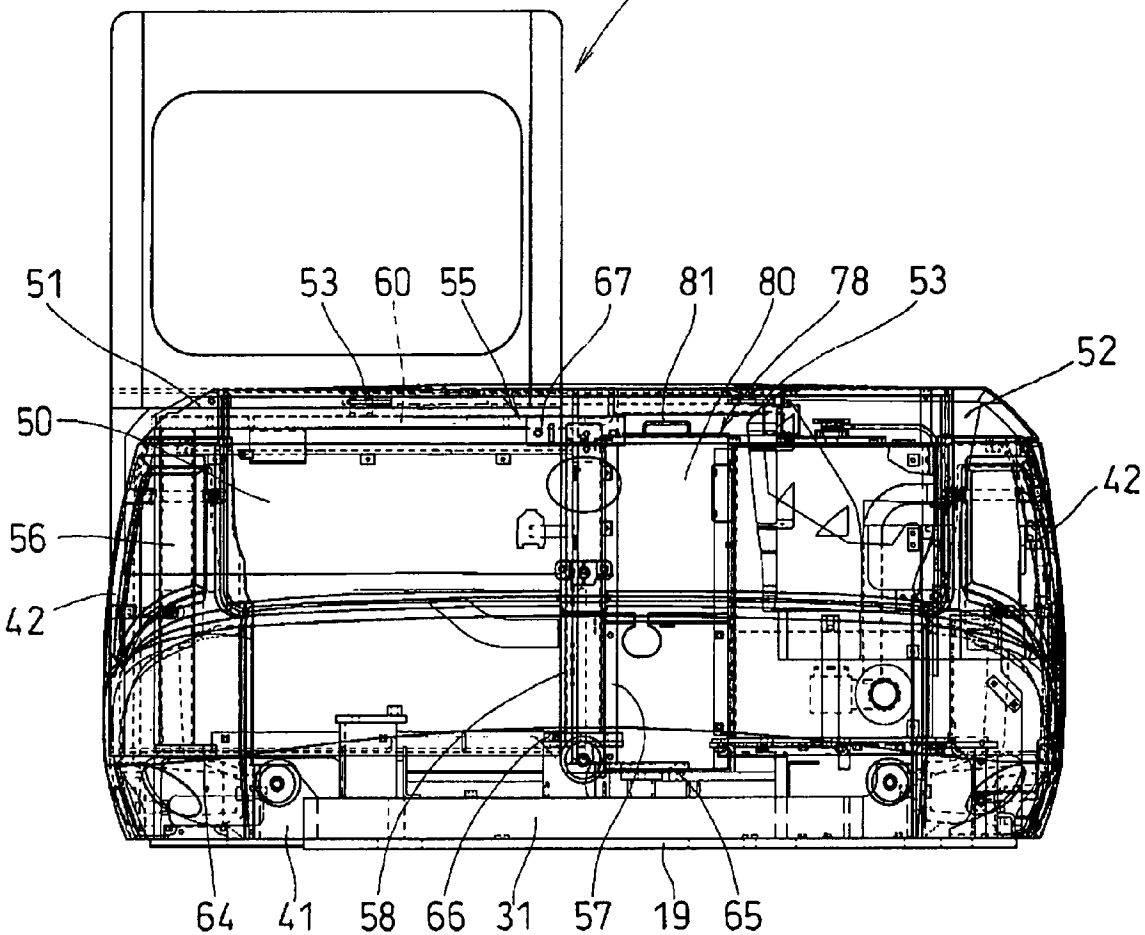
FIG. 6 is a rear view of the swivel deck with an implement detached therefrom.
Figure 7:
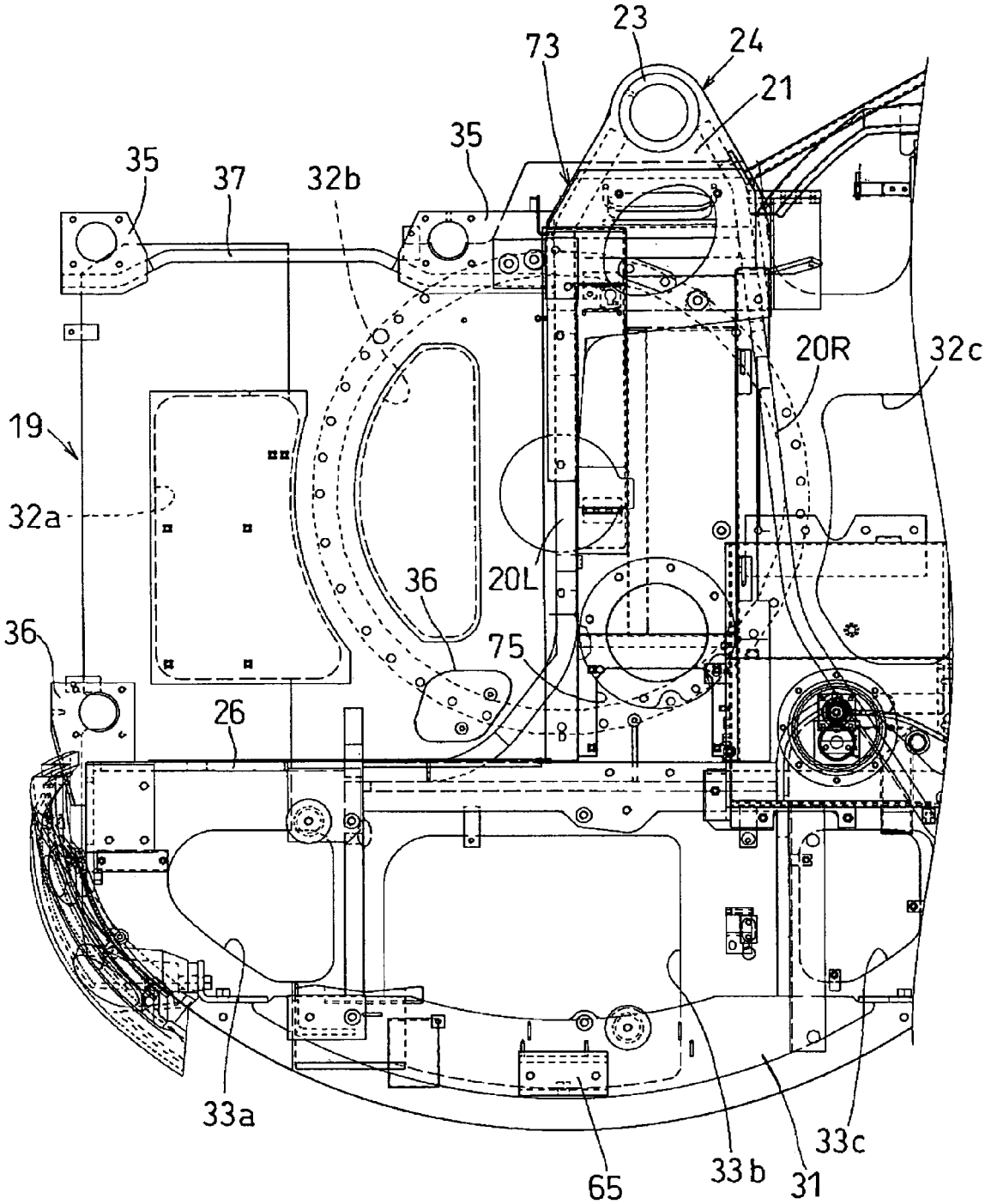
FIG. 7 is a plan view of a swivel base portion.
Figure 8:
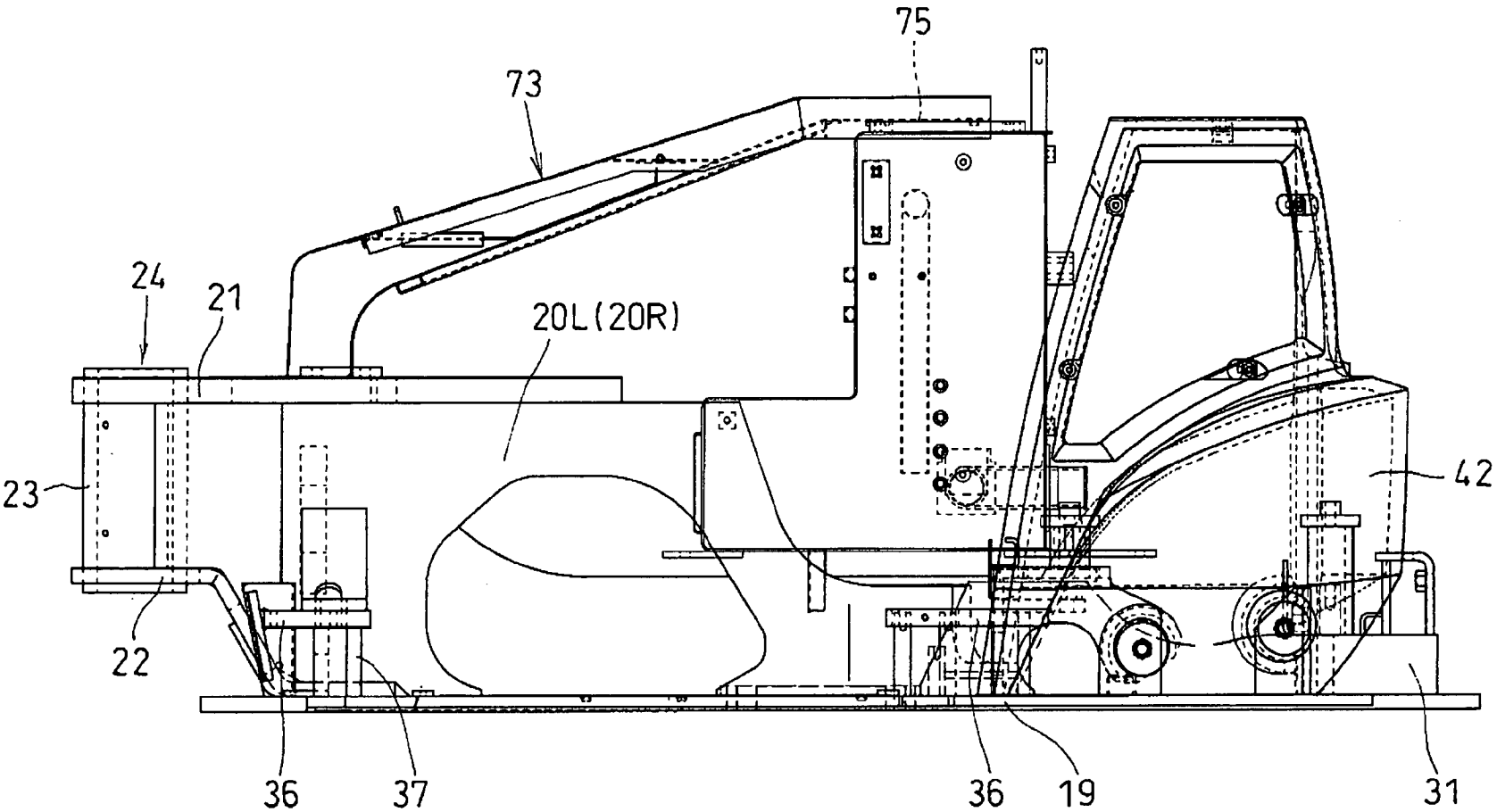
FIG. 8 is a left side view of the swivel base portion.
Figure 9:
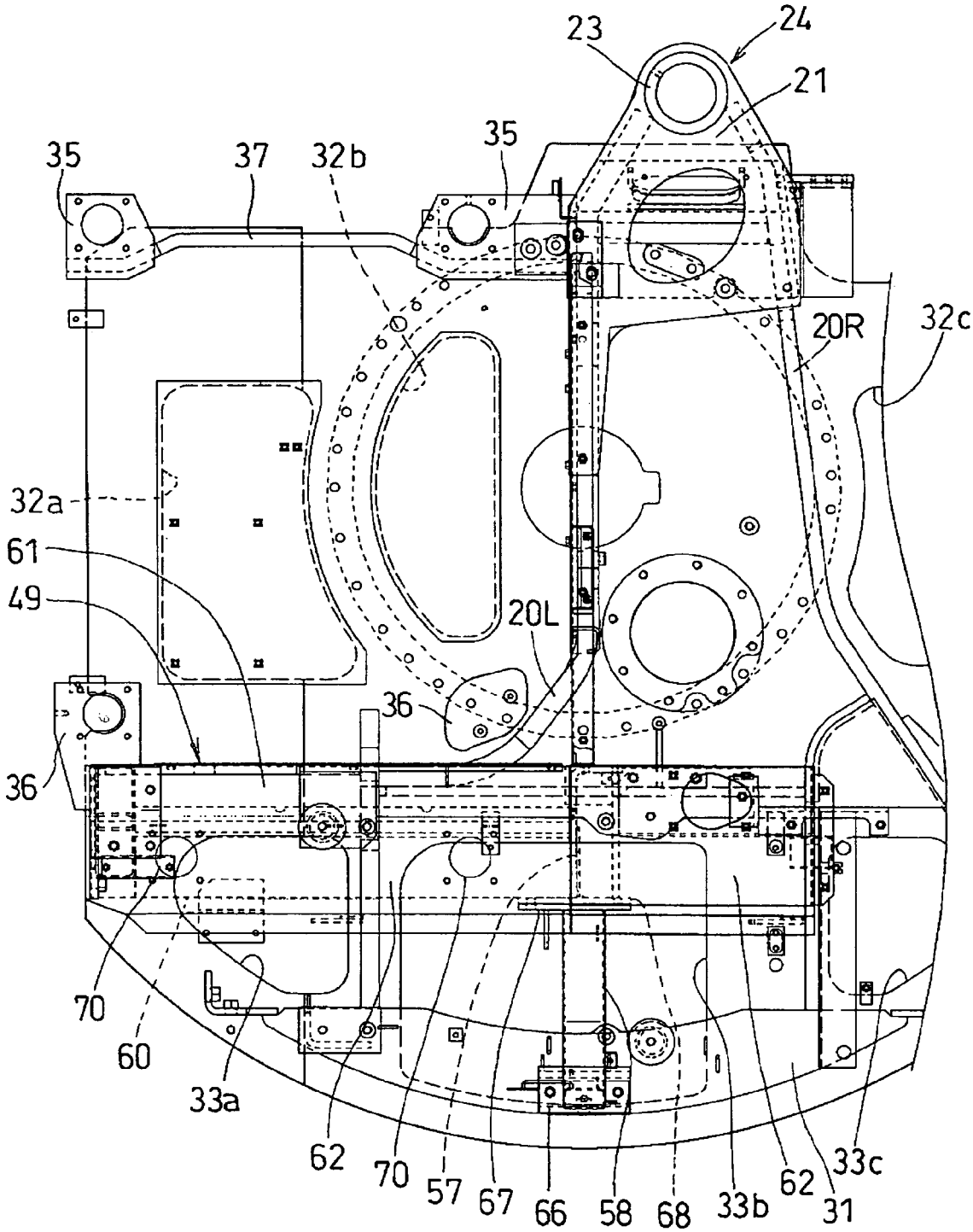
FIG. 9 is a plan view of the swivel base portion and a support frame.
Figure 10:
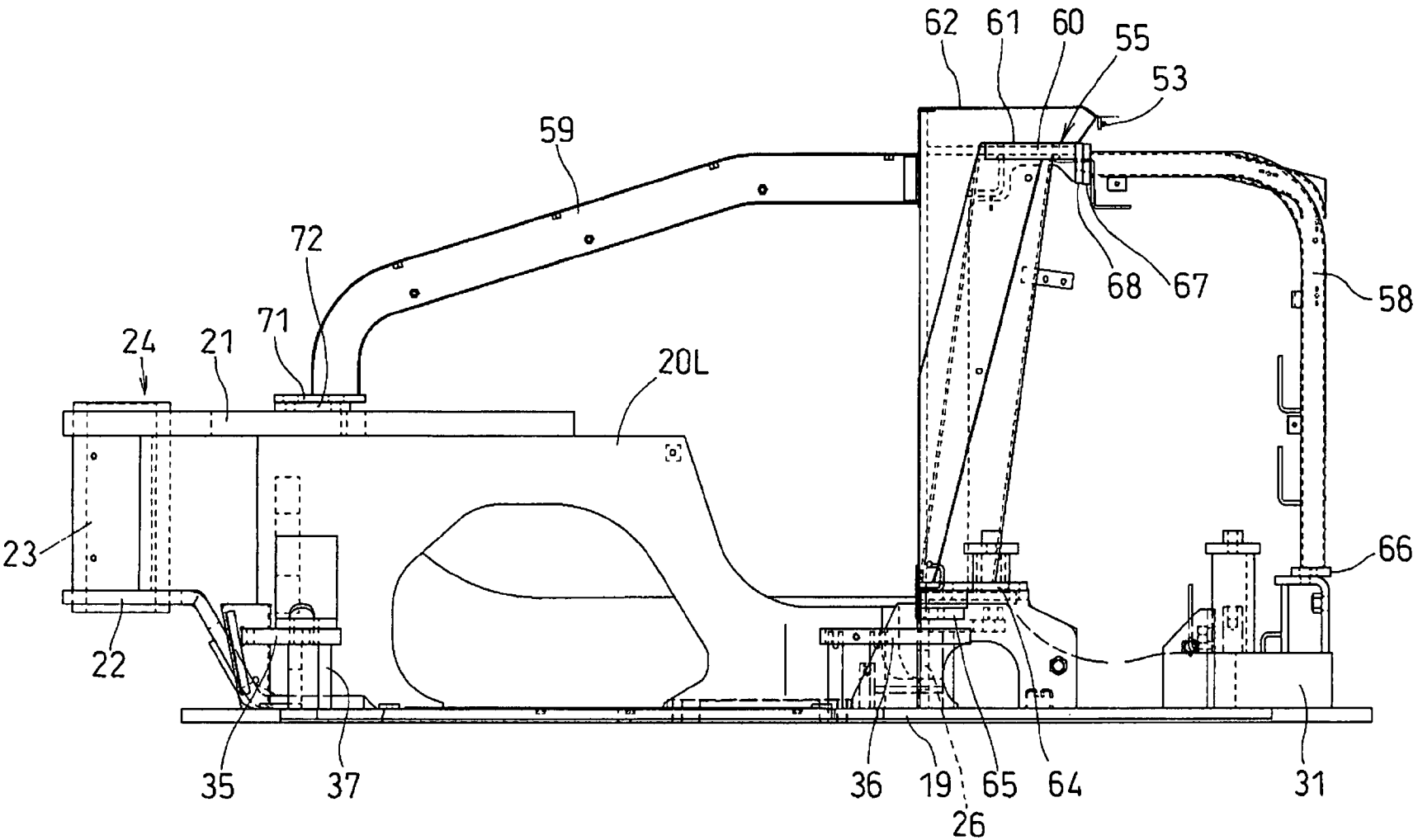
FIG. 10 is a left side view of the swivel base portion and a support frame.
Figure 11:
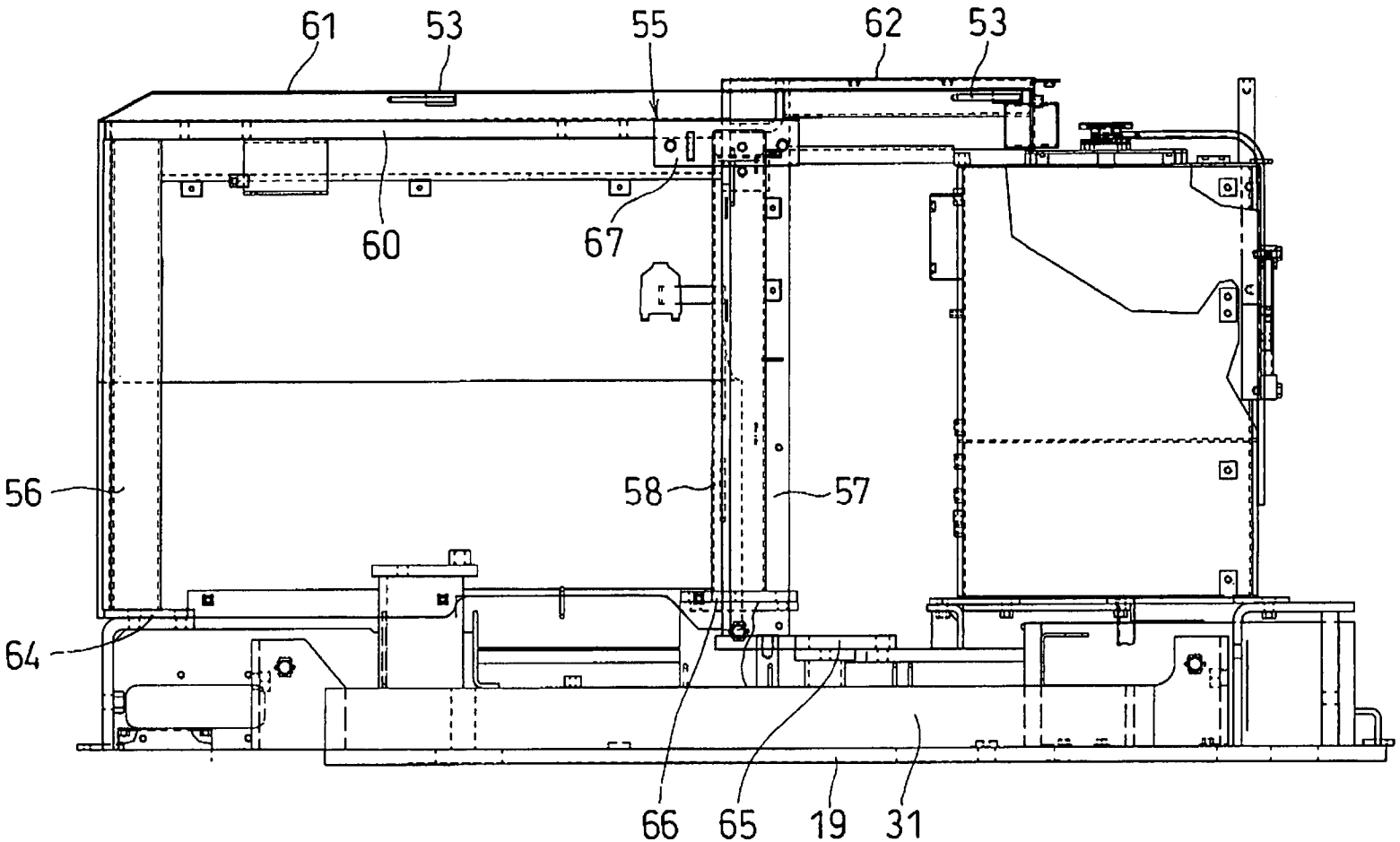
FIG. 11 is a rear view of the swivel base portion and the support frame.

The cabin 17 is mounted on the left side of the swivel base 19, with the rear end of the cabin 17 being placed on the rear hood 15. That is, as shown in FIG. 1 and FIG. 5, at the rear end portion of the cabin 17, there is provided a mounting recess 63 which is formed concave from the lower side to the upper side so as to be placed on the rear hood 15.

Though not shown, the cabin 17 is formed like a box having an open bottom and a lower end opening is provided at the lower end of the cabin 17 forwardly of the rear hood 15. As shown in FIG. 5, a step (bottom plate) 69 is detachably attached, by means of bolts or the like, to the lower end opening edge of the cabin 17 so as to close the lower end opening of the cabin 17.

Right and left two portions at the front end of the cabin 17 lower end (step 69) are fixedly attached via anti-vibration elements to the front cabin support members 35. Right and rear two portions at the rear end of the cabin 17 lower end (step 69) are fixedly attached via anti-vibration elements to the right and left cabin support members 36. Further, right and left two portions of the mounting recess 63 of the cabin 17 (rear end of the cabin 17) are fixedly attached, via the front cover 49 (right cover member 62) of the hood 15 and a pair of right and left anti-vibration elements 70, to the upper face of the support plate 60 of the support frame 55.

A cover member 73 is provided for covering, from an upper side of the front leg member 59, a region between the cabin 17 and the side hood 47. A first inspection window 75 is provided in a rear end upper face of the cover member 73. And, as shown in FIG. 20, a second inspection window 76 corresponding to the first inspection window 74 is provided in a front wall 15*a* of the rear hood 15 (front cover 49), and a lid member 78 for closing the first inspection window 75 and the second inspection window 76 is detachably attached to the cover member 73 by means of fixing members such as bolts.

The rear wall 15*a* of the rear hood 15 is vertically disposed immediately forwardly of the support frame 55 and immediately rearwardly of the rear end of the cover member 73. The upper end of the front wall 15*a* is connected to e.g. the left cover member 61 or the right cover member 52 of the support frame 55, thereby to close the front side of the interior of the rear hood 15 (engine room 27). The front leg member 59 of the support frame 55 projects much more forwardly than the front wall 15*a* of the rear hood 15.

Figure 20:
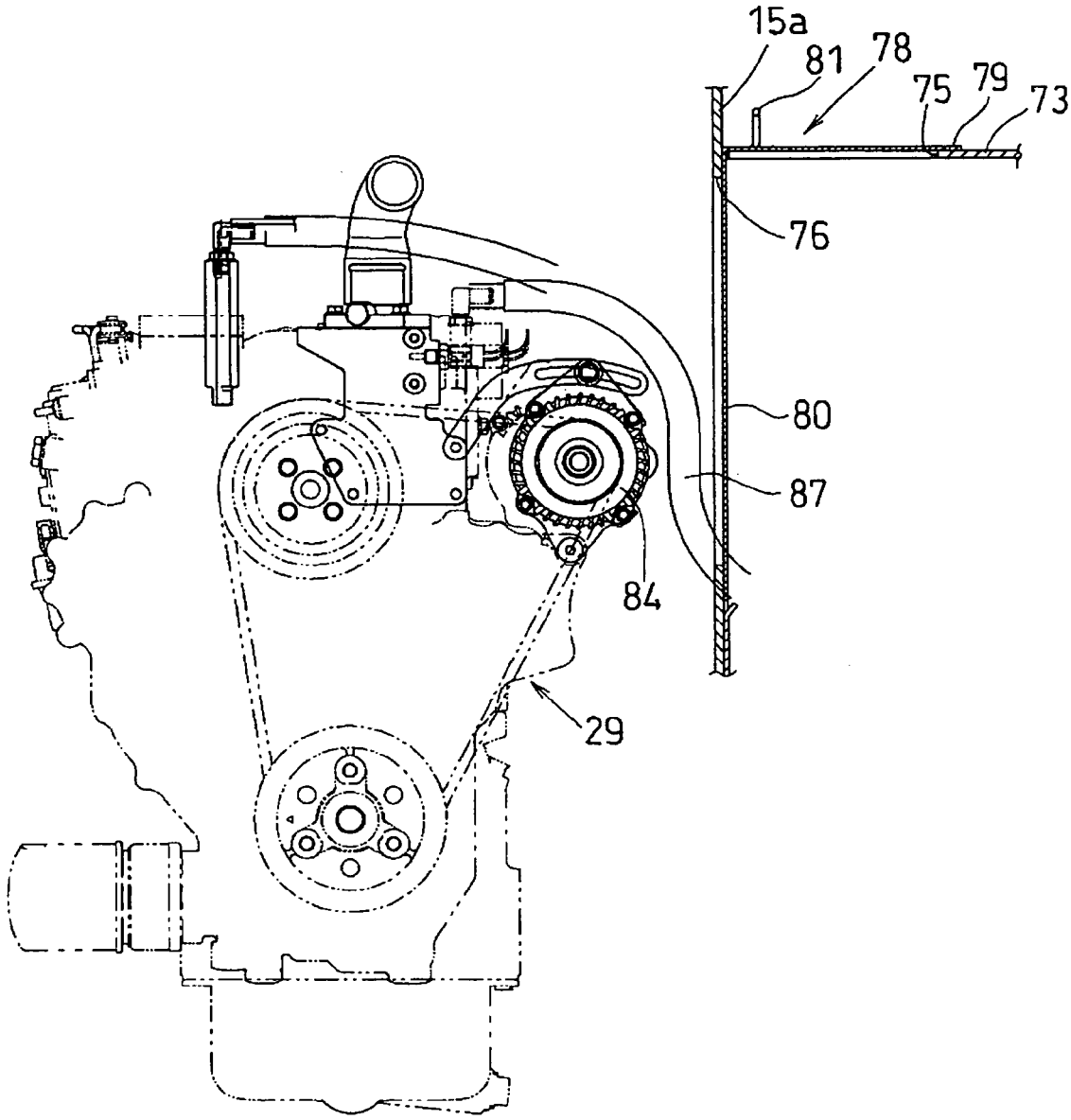
FIG. 20 is a right side view in section of an engine section.
Figure 21:
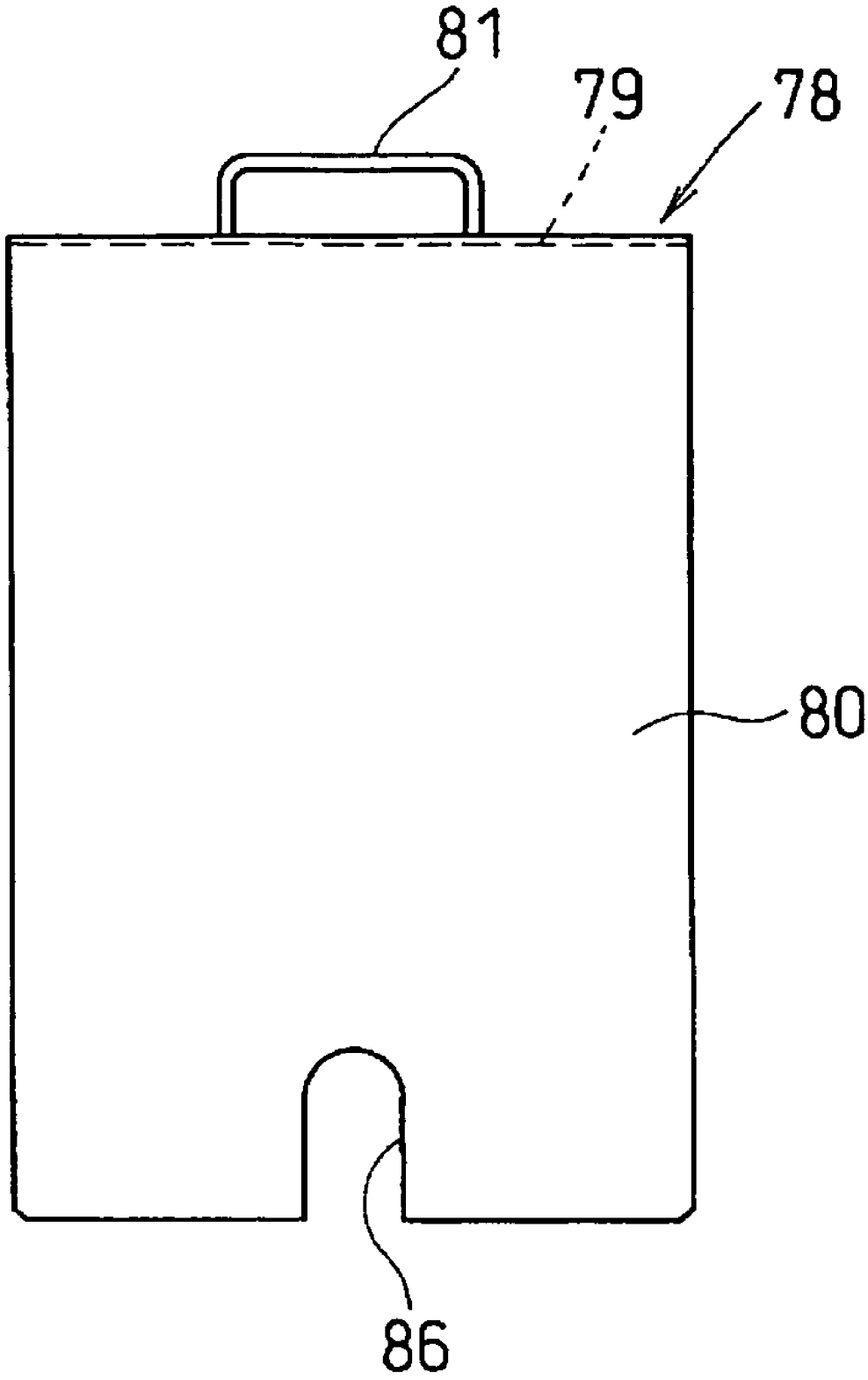
FIG. 21 is a rear view of a lid member.

As shown in FIG. 20 and FIG. 21, the lid member 78 includes a first lid plate portion 79 for covering the first inspection window 75 from the upper side thereof and a second lid plate portion 80 for covering the second inspection window 76 from the front side thereof, with the first and second plate portions 79, 80 together forming an L shape. The first lid plate portion 79 and the second lid plate portion 80 extend normal to each other to present an inverse L-shape in the side view. Further, the first lid plate portion 79 includes a grip portion 81.

As shown in FIGS. 8-14, on the upper face of the rear portion of the swivel base 19 inside the rear hood 15 (engine room 27), the engine 29 is mounted with a lateral orientation (i.e. with its crankshaft extending along the right and left direction). This engine 29 is fixedly mounted, via anti-vibration elements or the like, to the partitioning wall 26 and the attaching wall 31. Further, the engine 29 is disposed forwardly of the counter weight 41 and on the right side of the engine 29, a cooling fan 83 and the radiator are disposed. The cooling fan 83 is rotatably driven by power of the engine 29.

Figure 14:
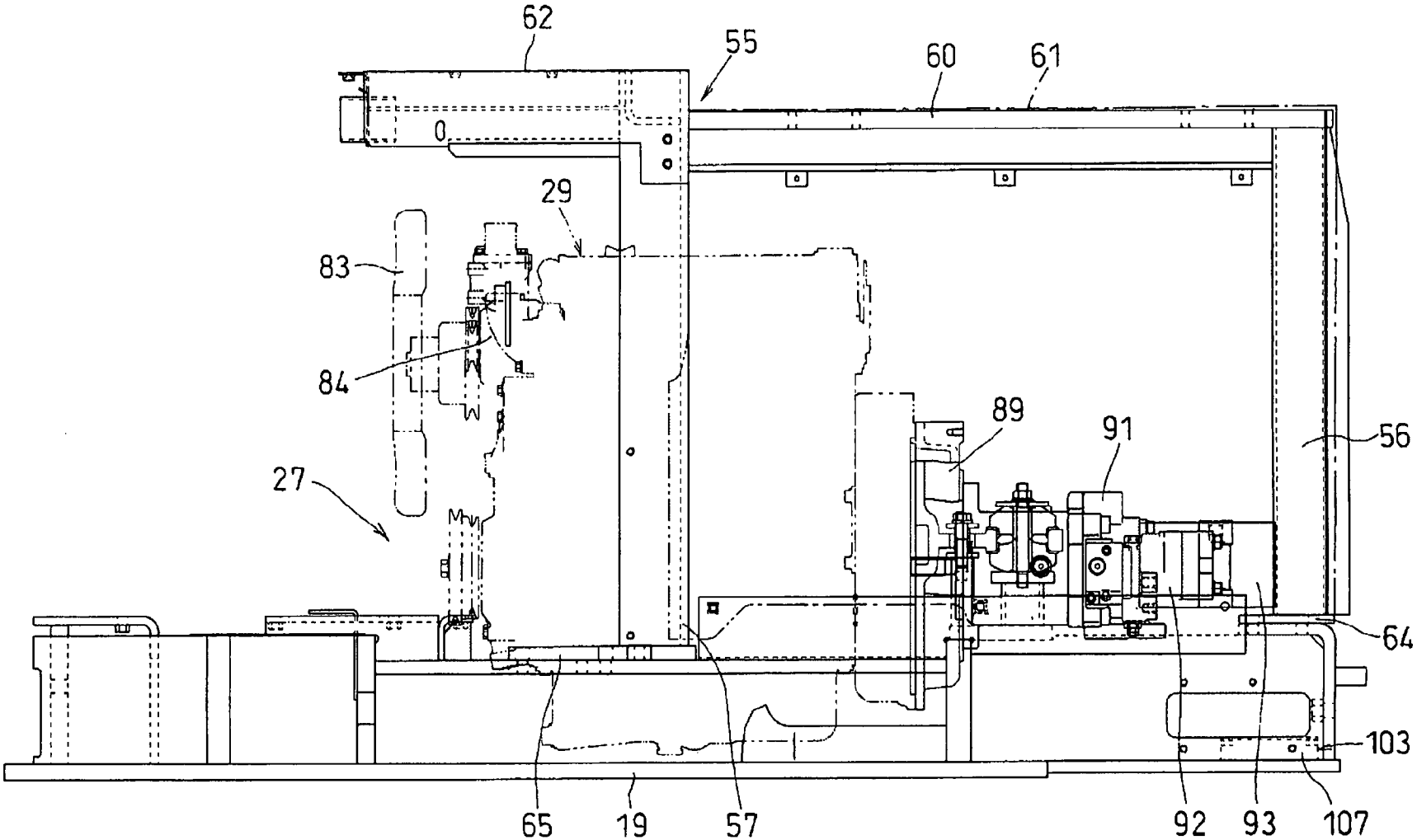
FIG. 14 is a front view of the rear end portion of the swivel deck.
Figure 15:
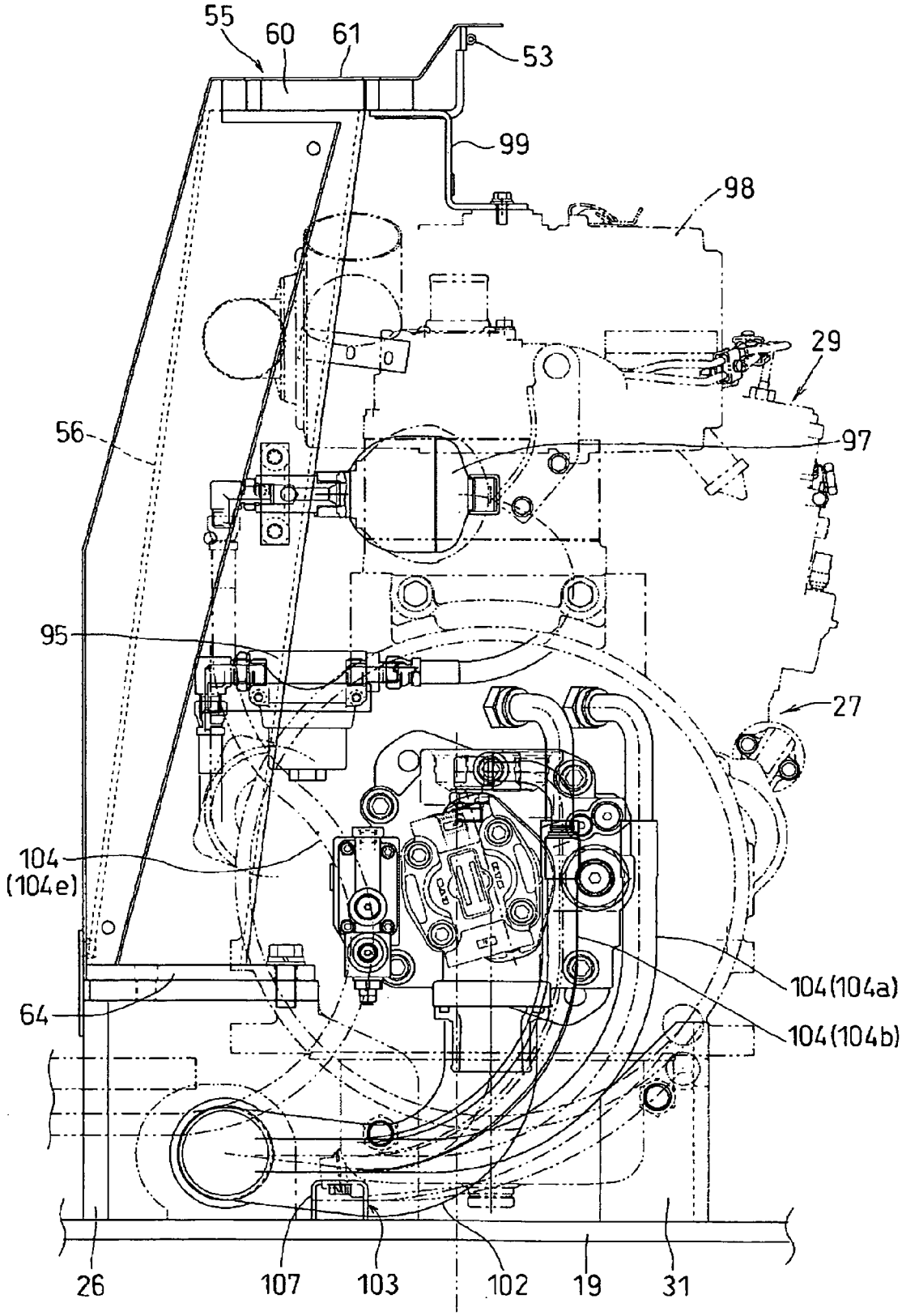
FIG. 15 is a left side view of the rear end portion of the swivel deck.
Figure 16:
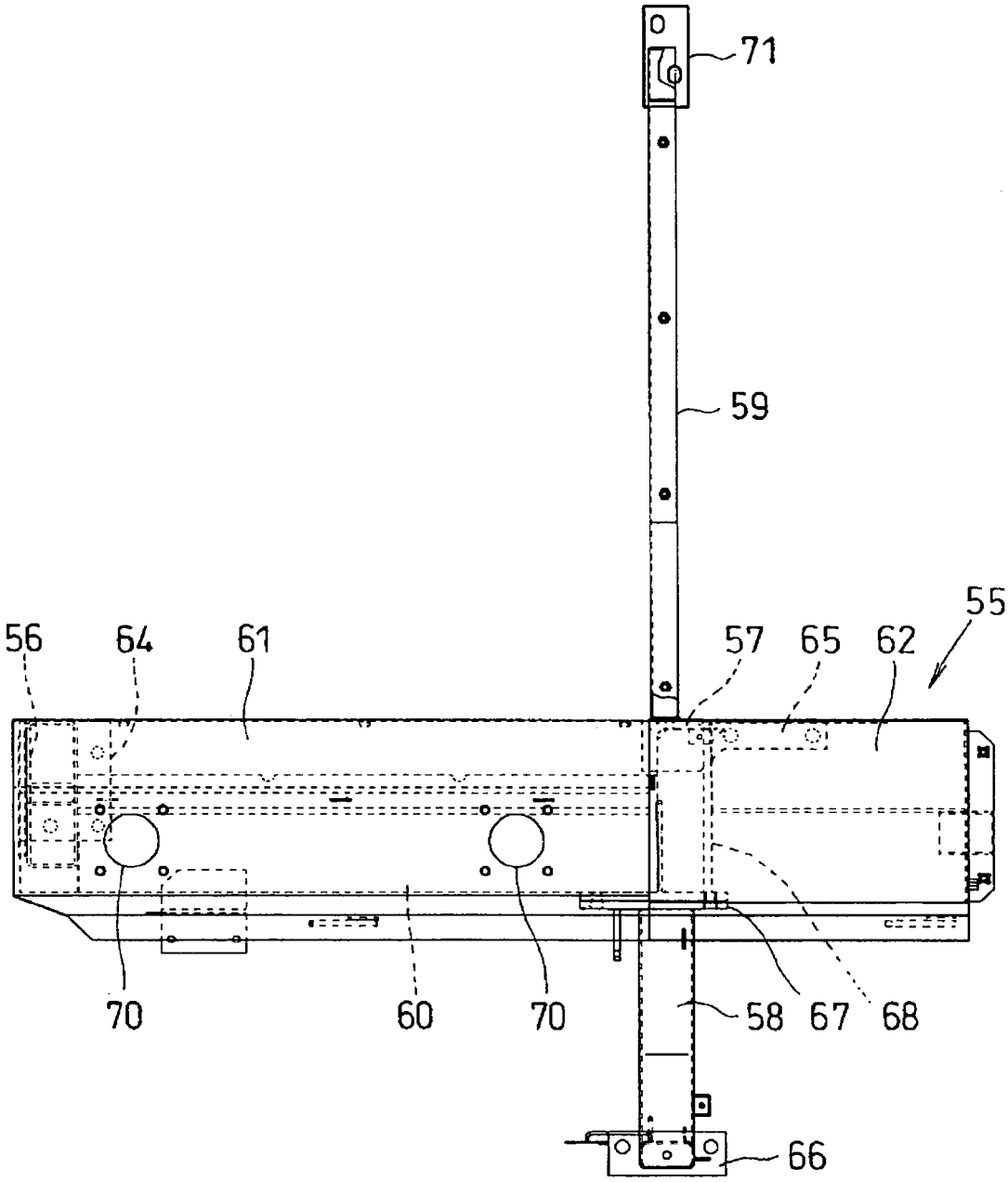
FIG. 16 is a plan view of the support frame.
Figure 17:
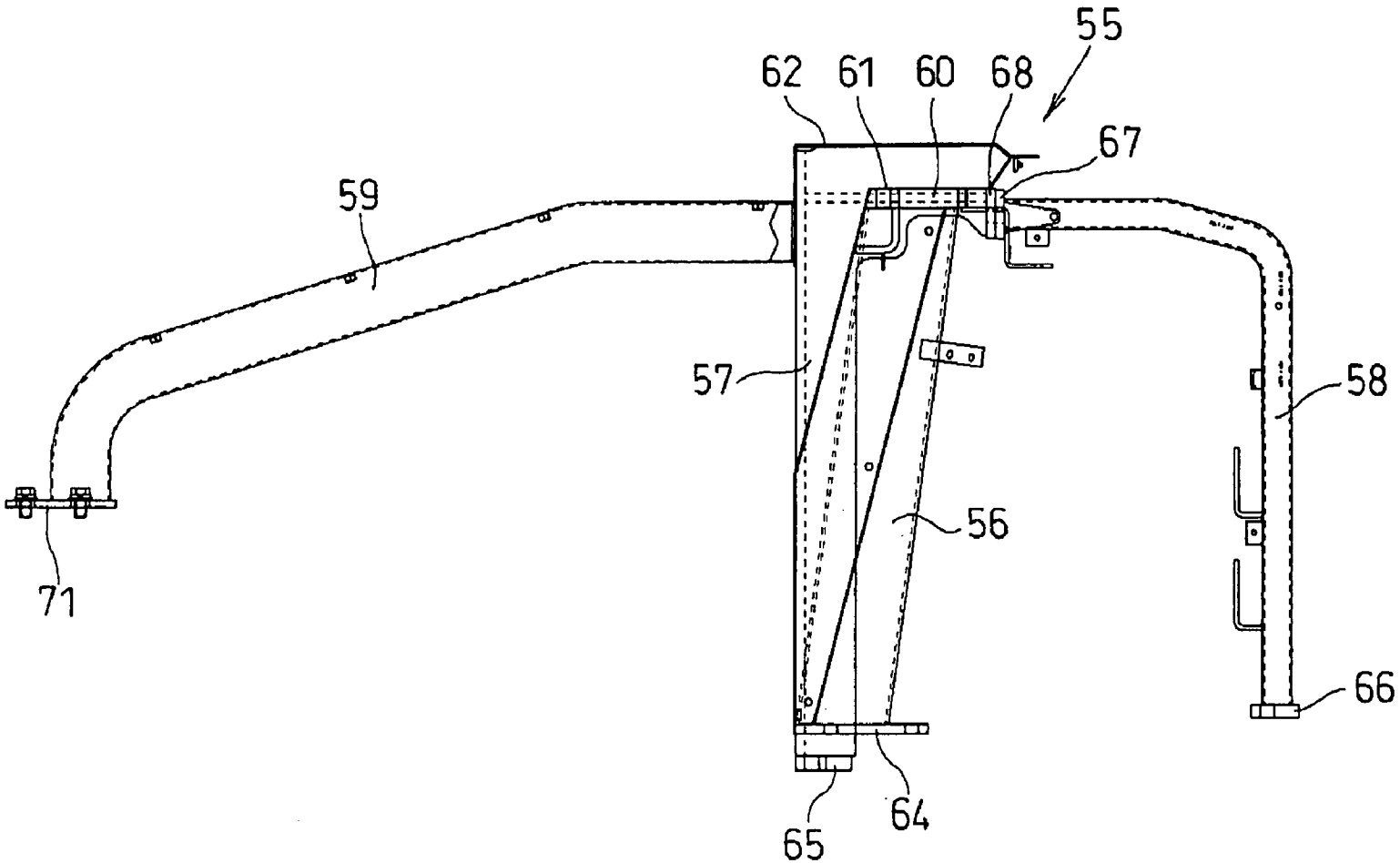
FIG. 17 is a left side view of the support frame.
Figure 18:
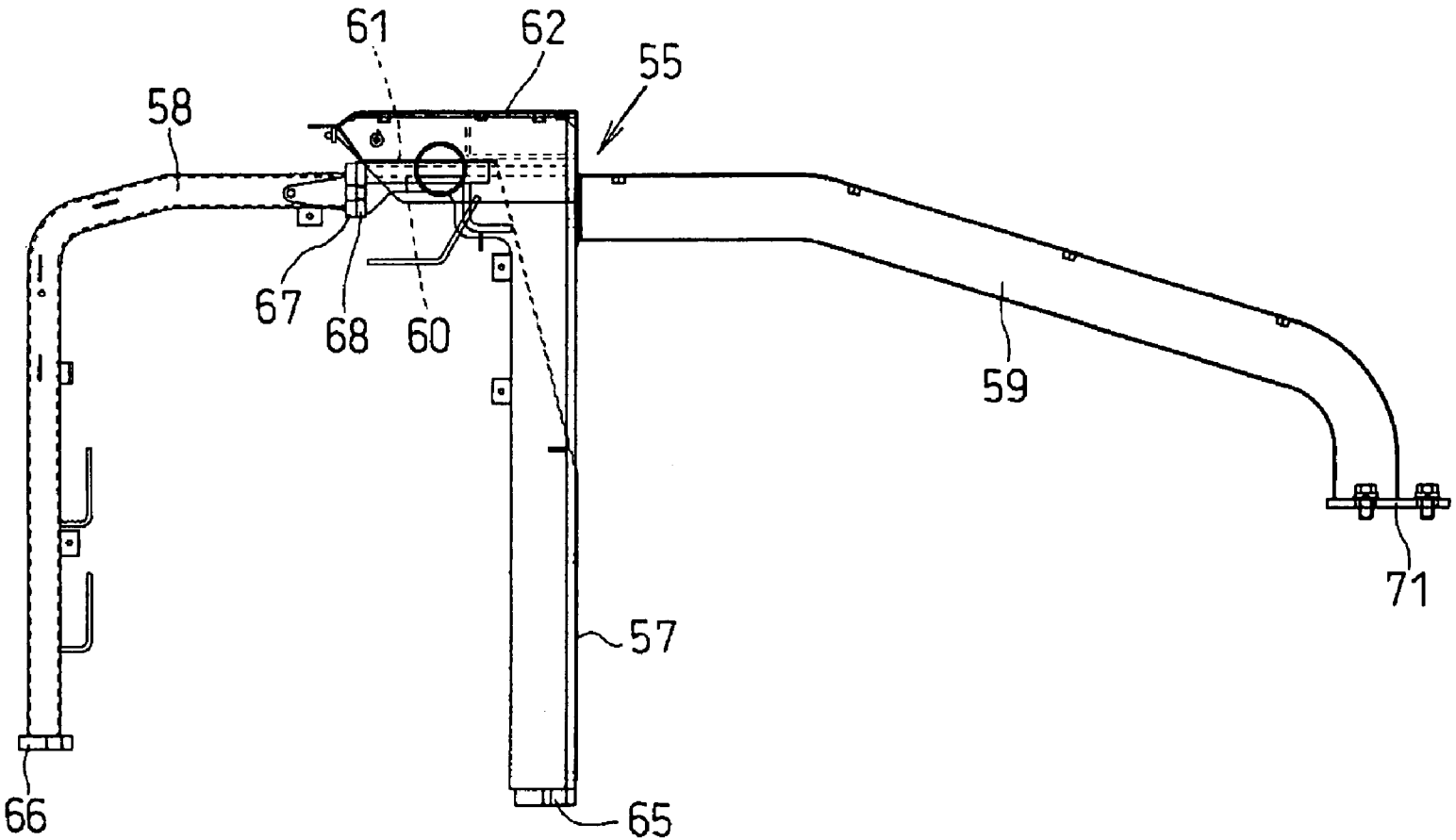
FIG. 18 is a right side view of the support frame.
Figure 19:
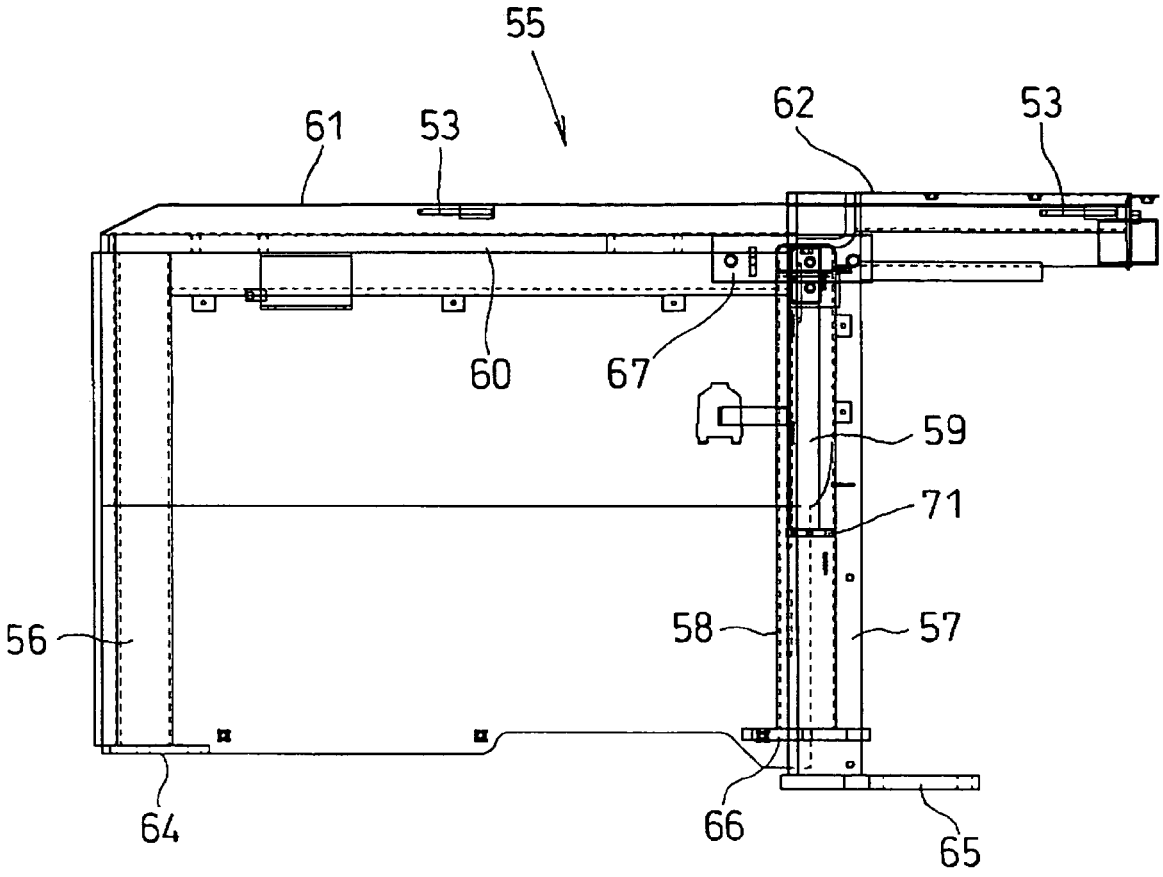
FIG. 19 is a rear view of the support frame.

As shown in FIG. 14 and FIG. 20, at a front upper end of the right side of the engine 29, an alternator 84 is provided. The second inspection window 76 is disposed at the position corresponding to the alternator 84. So that, with detachment of the lid member 78 from the cover member 73, the alternator 84 can be inspected through the first inspection window 75 and the second inspection window 76. At the lower end of the second lid plate portion 80 of the lid member 78, there is provided a cutout recess 86, into which a heater hose 87 projecting from the engine 29 is inserted and the heater hose 87 is drawn out to the front side through the cutout recess 86 from the rear hood 15 (engine room 27).

As shown in FIGS. 12-15, on the left side of the engine 29, there is provided a flywheel 89, and on its lateral side, there are disposed a first hydraulic pump 91, a second hydraulic pump 92 and a third hydraulic pump 93 for feeding working oil to the various hydraulic components (the hydraulic cylinders, 9, 10, 11, the hydraulic motor, control valves of the traveling apparatus 3, etc.). The first hydraulic pump 91 includes two LP pumps. These hydraulic pumps 91, 92, 93 are rotatably driven by the power of the engine 29. Inside the rear hood 15 and on the left side of the engine 29, there are provided, as further hydraulic components, a line filter 95, a check valve 96 and an accumulator 97. Further, at an upper portion of the left side of the engine 29, an air cleaner 98 is provided. This air cleaner 98 is attached to the support plate 60 of the support frame 55 via an attaching stay 99.

Though not shown, an unload valve for unloading the working oil discharged from the third hydraulic pump 93 is provided adjacent the lid member 78 disposed at the front portion of the rear hood 15. Further, though not shown, a signal block for transmitting signaling working oil to the various hydraulic components is provided, together with the unload valve, adjacent the lid member 78 disposed at the front portion of the rear hood 15.

At a front lower portion of the rear hood 15, there is disposed a hydraulic pipe 102 along the right/left direction. This hydraulic pipe 102 is connected to the working oil tank disposed inside the side hood 47 and also to the hydraulic pumps 91, 92, 93 so as to feed the working oil from the working oil tank to the hydraulic pumps 91, 92, 93.

Further, though not shown, on the right side etc. of the engine 29 inside the rear hood 15, there are provided various air conditioning components such as an air conditioning condenser, an air conditioning compressor, etc., and at a front portion etc. of the rear hood 15, an air conditioning unit (air conditioning body) is provided.

Figure 12:
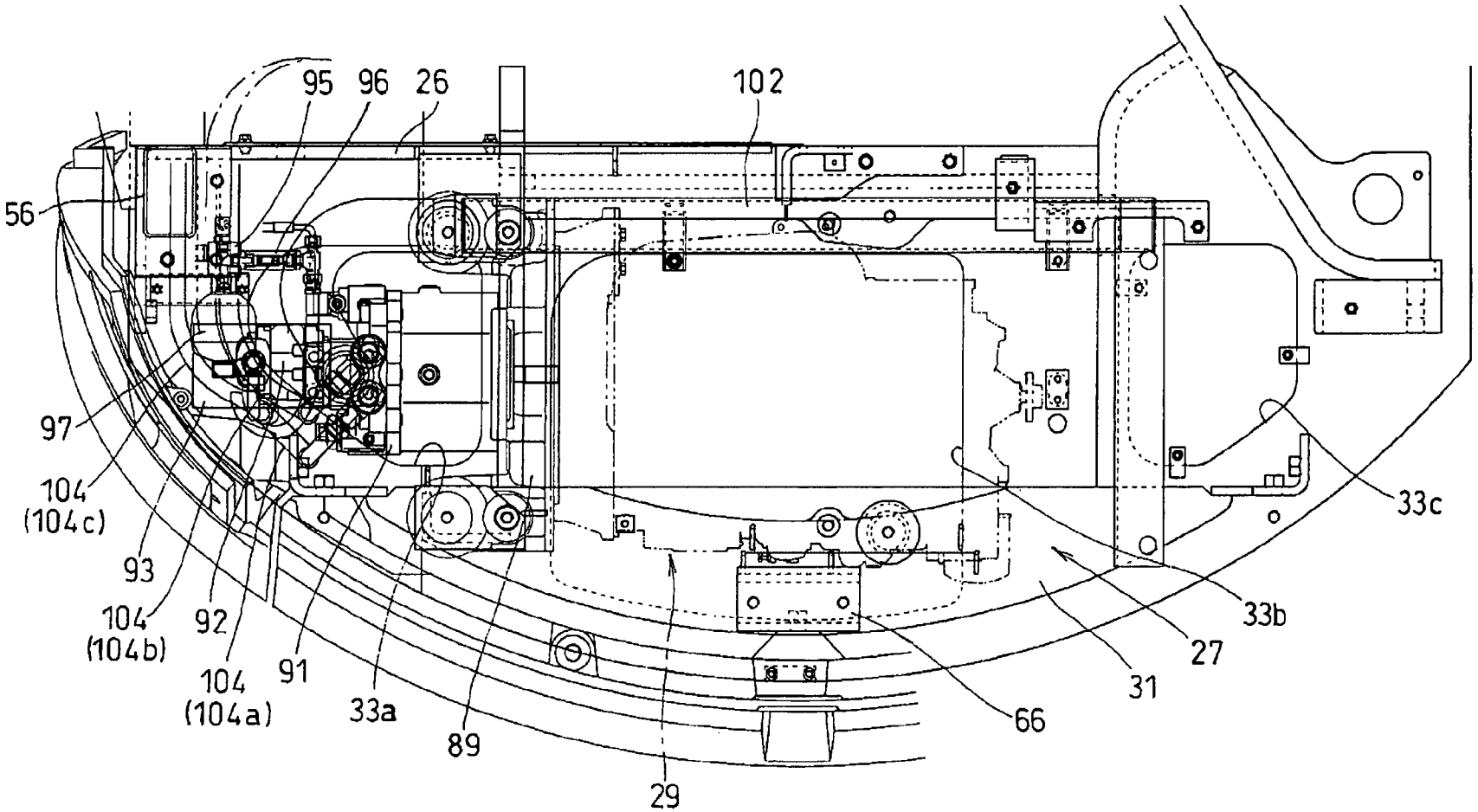
FIG. 12 is a plan view of a rear end portion of the swivel deck.
Figure 13:
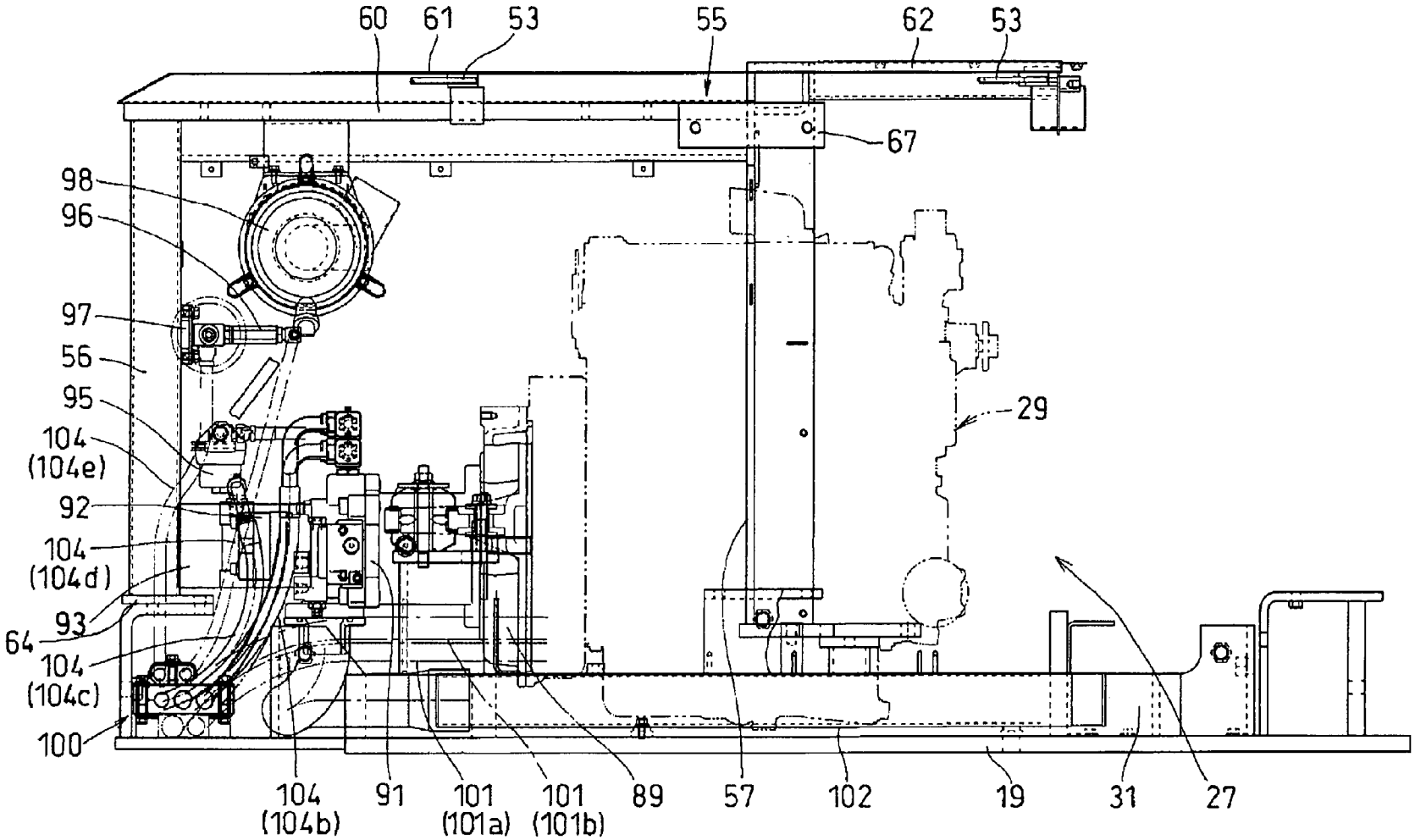
FIG. 13 is a rear view of the rear end portion of the swivel deck.

As shown in FIGS. 12 and 13, at the right lower portion inside the rear hood 15, there are disposed air conditioning pipes 101 (101*a*, 101*b*). Via these air conditioning pipes 101*a*, 101*b*, the air conditioning components inside the rear hood 15 and the air conditioning body outside the rear hood 15 are connected for circulating cooling medium between the air conditioning components and the air conditioning unit.

Inside the rear hood 15, there is provided an air conditioning pipe holding member 100. This pipe holding member 100 is disposed on the left outer side of the engine 29 and adjacent the hydraulic pumps 91, 92, 93, so as to concentrate and hold the plurality of air conditioning pipes 101 (101*a*, 101*b*) and a plurality of hydraulic pipes 104 (104*a*, 104*b*, 104*c*, 104*d*, 104*e*) all together.

Figure 22:
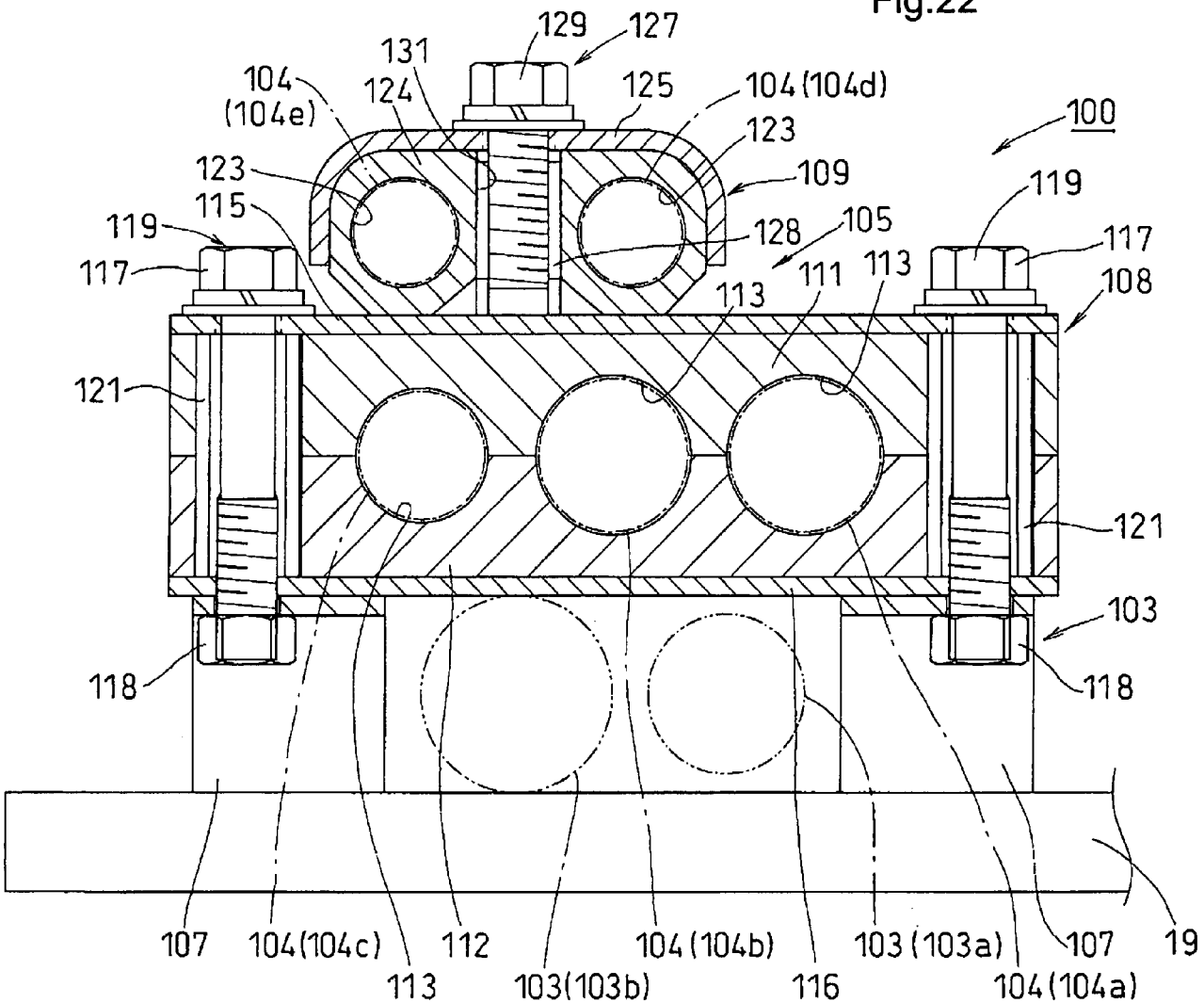
FIG. 22 is a rear view in section of a pipe holding member.
Figure 23:
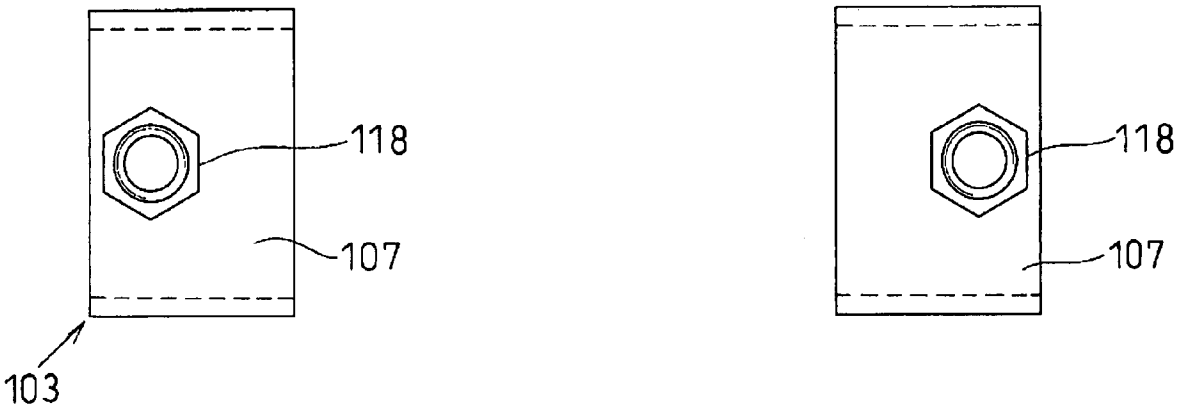
FIG. 23 is a plan view of an air conditioning pipe holding portion.
Figure 24:
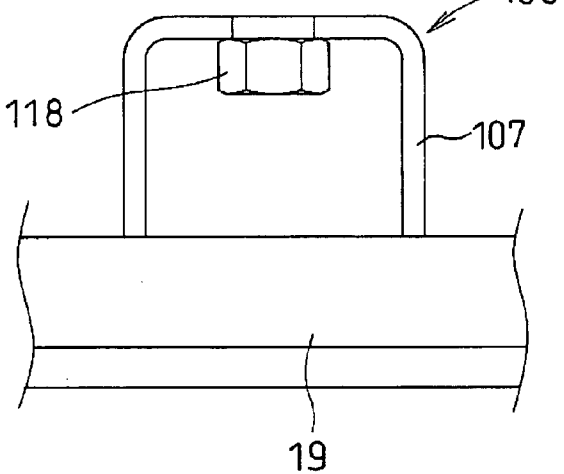
FIG. 24 is a left side view of the air conditioning pipe holding portion.

Referring also to FIGS. 22-24, this pipe holding member 100 includes an air conditioning pipe holding portion 103 for holding the plurality of air conditioning pipes 101 (101*a*, 101*b*) and a hydraulic pipe holding portion 105 for holding the plurality of hydraulic pipes 104 (104*a*, 104*b*, 104*c*, 104*d*, 104*e*), with the two holding portions 103, 105 being vertically superposed with each other.

The air conditioning pipe holding portion 103 includes a pair of right and left support tables 107 fixed on the swivel base 19. And, between and upwardly of this pair of support tables 107, the hydraulic pipe holding portion 105 is provided, and the plural air conditioning pipes 101*a*, 101*b* are inserted between the pair of support tables 107 downwardly of the hydraulic pipe holding portion 105.

The hydraulic pipe holding portion 105 includes a lower pipe holding member 108 and an upper pipe holding member 109, with the lower pipe holding member 108 being fixedly mounted on the air conditioning pipe holding portion 103 and the upper pipe holding member 109 being fixedly mounted on the lower pipe holding member 108.

The lower pipe holding member 108 includes a pair of upper and lower pipe clamping members 111, 112, which are formed of rubber or synthetic resin having elasticity. And, these pipe clamping members 111, 112 form therebetween a plurality of insertion holes 113 for inserting the hydraulic pipes 104*a*, 104*b*, 104*c*. The upper and lower pair of pipe clamping members 111, 112 are vertically clamped with each other by means of an upper clamping plate 115 and a lower clamping plate 116, respectively, and are vertically fastened to each other via the upper and lower pair of clamping plates 115, 116 by means of fasteners 119.

At the right and left opposed ends of the pair of upper and lower pipe clamping members 111, 112, cylindrical members 121 are inserted and held. And, the pair of fasteners 119 are provided on the right and left. Each fastener 119 can comprise a bolt 117 and a nut 118, for example. The nut 118 is fixedly attached to each support table 112 by means of welding or the like. Each fastener 119 is inserted through the pair of pipe clamping members 111, 112 and also through the cylindrical member 121, thus being inserted through the pair of upper and lower clamping plates 115, 116. Further, the pair of fasteners 119 are inserted into the support tables 107. So that, when the fasteners 119 are fastened, the pair of upper and lower pipe clamping members 111, 112 are vertically fastened to each other as described above and at the same time the lower pipe holding member 108 is fastened and fixed to the support tables 107.

The upper pipe holding member 109 includes a pipe holding body 124 defining a plurality of insertion holes 123 for inserting hydraulic pipes 104*d*, 104*e* and a press plate 125 disposed on the pipe holding body 124, so that the pipe holding body 124 may be vertically clamped by a fastener 127 between the press plate 125 and the upper clamping plate 115 of the lower pipe holding member 108. The fastener 127 includes a threaded cylinder 128 projecting upwardly from the upper clamping plate 115 and a bolt 129 to be threaded on the threaded cylinder 128. The threaded cylinder 128 is inserted and engaged through the insertion hole 131 of the pipe holding body 124 within this pipe holding body 124. The bolt 129 is inserted from above into the press plate 125 and threaded on the threaded cylinder 128. As the fastener 127 is fastened, the pipe holding body 124 is vertically clamped between the press plate 125 and the upper clamping plate 115 as described above.

The hydraulic pipes 104*a*, 104*b* are pipes connected to a discharging side of the first hydraulic pump 91. These pipes 104*a*, 104*b* project from the first hydraulic pump 91 and are inserted and held in the lower pipe holding member 108 through the insertion holes 113 and then extend forwardly therefrom and are drawn out to the front side of the rear hood 15, thereby feeding working oil from the first hydraulic pump 91 to the various hydraulic components (the boom cylinder 9, the bucket cylinder 10, the arm cylinder 11, the hydraulic motor and control valves of the traveling apparatus 3, etc.).

As shown in FIGS. 12-15, the hydraulic pipe 104*c* is a pipe connected to a discharging side of the second hydraulic pump 92. The hydraulic pipe 104*c* projects from the second hydraulic pump 92 and then is inserted and held within the lower pipe holding member 108 through the insertion hole 123 and then extends forwardly to be drawn out to the front side of the rear hood 15, feeding working oil from the first hydraulic pump 91 to the various hydraulic components (the boom cylinder 9, the bucket cylinder 10, the arm cylinder 11, the hydraulic motor and control valves of the traveling apparatus 3, etc.).

The hydraulic pipe 104*d* is a pipe for signaling connecting between the signal block with the line filter 95 or the check valve 96. This pipe 104*d* projects from the line filter 95 or the check valve 96 and is inserted through and within the upper pipe holding member 109 through the insertion hole 123 and then extends forwardly to be drawn out to the front side of the rear hood 15 to be connected with the signal block.

The hydraulic pipe 104*e* is a pipe connected to the check valve 96 and the unload valve. This pipe 104*e* projects from the check valve 96 and is inserted through and within the upper pipe holding member 109 through the insertion hole and then extends forwardly to be drawn out to the front side of the rear hood 15 to be connected with the unload valve.

Incidentally, a discharging side of the third hydraulic pump 93 and the line filter 95 are connected to each other via an unillustrated hydraulic pipe, and the line filter 95 and the check valve 96 are connected to each other via an unillustrated hydraulic pipe.

As described above, according to the present invention, as the front leg member 59 projects forwardly to be located on one lateral side of the cabin 17, this front leg member 59 extends by greater span in the fore and aft direction than the conventional construction. Therefore, even when the upper portion of the cabin 17 is subjected to a significant load to the front side, this front load can be sufficiently supported by the stiff projection of the front leg member 59, thus avoiding development of looseness of the support frame 55 to the front side.

Further, as this front leg member 59 is formed of a metal rod having a C-shaped cross section, the nut or the like for attaching the cover member 73 can be readily and conveniently affixed to the rear side (lower side) of the front leg member 59.

For inspecting the alternator 84 disposed inside the rear hood 15, by detaching the lid member 78 from the cover member 73, the first inspection window 75 provided at the rear end upper portion of the cover member 73 and the second inspection window 76 provided in the front wall 15*a* of the rear hood 15 can be opened and exposed at one time, thus allowing an operator's hand access to the alternator 84 through the first inspection window 75 and the second inspection window 76. And, it is also possible to draw out the alternator 84 altogether through the first inspection window 75 and the second inspection window 76 to the front side of the rear hood 15, whereby the inspection or maintenance of the alternator 84 can be carried out easily.

Further, as the pipe holding member 100 for concentrating and holding the plural air conditioning pipes 101 and the plural hydraulic pipes 104 all together is disposed inside the hood 15, these air conditioning pipes 101 and the hydraulic pipes 104 can be held in a concentrated manner at one position inside the hood 15. Hence, the handling and laying out operations of these hydraulic pipes 104 and the air conditioning pipes 101 can be carried out easily as well. Moreover, as the pipe holding member 100 includes the air conditioning pipe holding portion 103 for holding the plurality of air conditioning pipes 101 and the hydraulic pipe holding portion 105 for holding the plurality of hydraulic pipes 104, with these two holding portions 103, 105 being vertically superposed with each other, the entire pipe holding member 100 can be formed compact and also the plurality of air conditioning pipes 101 and the plurality of hydraulic pipes 104 can be laid out and fixed in a compact manner in a plurality of stages.

Further, as the openings 33*a* of the swivel base 19 are provided adjacent the hydraulic pumps 91, 92, 93 and the pipe holding member 100, heat radiated from the hydraulic pumps 91, 92, 93 and the plurality of air conditioning pipes 101 and the plurality of hydraulic pipes 104 can be smoothly discharged through these openings 33*a* to the outside of the rear hood 15, thus effectively preventing accumulation and stagnation of such heat inside the rear hood 15.

Second Embodiment

Figure 25:
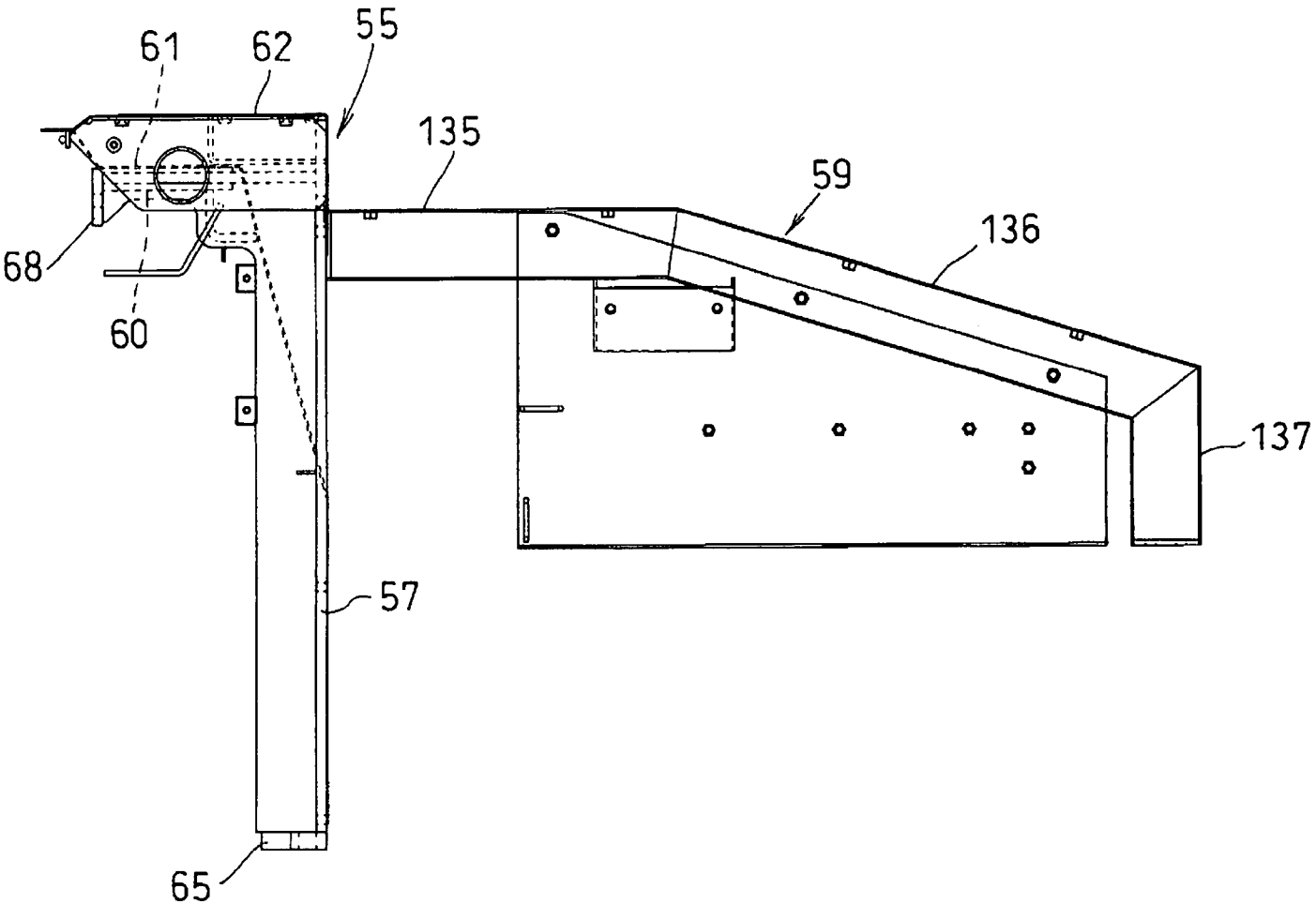
FIG. 25 is a right side view of a support frame of a swiveling work machine (backhoe) relating to a second embodiment of the invention.

FIG. 25 shows a swiveling work machine according to a second embodiment of the present invention.

In the first embodiment described above, the front leg member 59 of the support frame 55 is provided as a one-piece member. Instead, in this second embodiment, as shown in FIG. 25, the front leg member 59 is constructed as an inter-bonded assembly of three metal rods 135, 136, 137 each having a C-shaped cross section and a linear shape, with the rods 135, 136, 137 being bonded together by means of welding or the like.

The rest of this second embodiment is identical to the first embodiment.

Other Embodiments

In the foregoing respective embodiments, on the front side of the hood 15, the cabin 17 as an example of ROPS is provided and the front portion of the cabin 17 is fixedly mounted on the swivel base 19 and the rear end of the cabin 17 is fixedly mounted on the upper portion of the support frame 55. However, the ROPS is not limited to such a cabin 17. Instead of the cabin 17, any other type of ROPS such as a canopy, a safety frame, can be provided on the front side of the hood 15, and the front portion of this ROPS may be fixedly mounted on the swivel base 19 and the rear end of the ROPS may be fixedly mounted on the upper portion of the support frame 55.

Further, the arrangements of the components to be mounted on the swivel deck 4 (swivel base 19) can be reverse in the right/left direction. For instance, the ROPS such as the cabin 17 may be arranged on the right side of the swivel base 19 and the side hood 47 may be arranged on the left side thereof.

Moreover, instead of the single front leg member 59 provided in the support frame 55 in the foregoing embodiments, a plurality of front leg members can be provided to extend respectively upwardly of a plurality of vertical ribs.

The invention claimed is:

1. A swiveling work machine comprising:

a traveling apparatus;

a swivel base mounted on the traveling apparatus to be pivotable about a vertical axis;

a hood disposed at a rear portion of the swivel base, the hood accommodating therein an engine, a support frame being disposed across over the engine;

a rollover protection structure (ROPS) having a front end thereof fixed to the swivel base and a rear end thereof fixed to an upper portion of the support frame;

a vertical rib disposed erect on the swivel base; and a swing bracket connected to a front end of the vertical rib for pivotally supporting an implement, wherein said support frame includes a front leg member disposed on one lateral side of said ROPS, said front leg member extending to the vicinity of a front end of the swivel base, and a front end of said front leg member being fixed to a forward upper face of said vertical rib in the vicinity of an upper end of said swing bracket.

2. The swiveling work machine according to claim 1, wherein an upper plate is fixed to the forward upper face of the vertical rib and the front end portion of the front leg member is fixed to an upper face of said upper plate.

3. The swiveling work machine according to claim 1, wherein said ROPS is provided at a front portion on one lateral side of the swivel base, and a side hood is provided at a front portion on the other lateral side of the swivel base, said front leg member extending between said side hood and said ROPS.

4. The swiveling work machine according to claim 3, wherein a cover member is provided for covering, from an upper side of the front leg member, a region between said ROPS and said side hood;

a first inspection window is provided in a rear end upper face of the cover member;

a second inspection window corresponding to said first inspection window is provided in a front wall of said hood; and a lid member for closing said first inspection window and said second inspection window is detachably attached to said cover member.

5. The swiveling work machine according to claim 4, wherein said lid member includes a first lid plate portion for covering said first inspection window from the upper side thereof and a second lid plate portion for covering said second inspection window from the front side thereof, with the first lid plate portion and the second lid plate portion extending normal to each other.

6. The swiveling work machine according to claim 5, wherein said engine includes an alternator, said second inspection window being disposed at a position corresponding to said alternator, said alternator being inspectable through said first inspection window and said second inspection window, when said lid member is detached from said cover member.

* * * * *